US012618623B2

(12) United States Patent
Russell

(10) Patent No.: US 12,618,623 B2
(45) Date of Patent: May 5, 2026

(54) DYNAMIC RAM ACCELERATOR SYSTEM

(71) Applicant: PIPELINE2SPACE, INC., Spokane, WA (US)

(72) Inventor: Mark C. Russell, Spokane, WA (US)

(73) Assignee: PIPELINE2SPACE, INC., Spokane, WA (US)

( * ) Notice: Subject to any disclaimer, the term of this patent is extended or adjusted under 35 U.S.C. 154(b) by 0 days.

(21) Appl. No.: 18/341,254

(22) Filed: Jun. 26, 2023

(65) Prior Publication Data

US 2023/0417499 A1 Dec. 28, 2023

Related U.S. Application Data

(60) Provisional application No. 63/367,188, filed on Jun. 28, 2022, provisional application No. 63/367,096, filed on Jun. 27, 2022.

(51) Int. Cl.
*F41A 1/02* (2006.01)
*F41A 21/28* (2006.01)

(52) U.S. Cl.
CPC ..... *F41A 1/02* (2013.01); *F41A 21/28* (2013.01)

(58) Field of Classification Search
CPC ..... F41A 1/02; F41A 1/04
See application file for complete search history.

(56) References Cited

U.S. PATENT DOCUMENTS 5,097,743 A 3/1992 Hertzberg et al.
5,121,670 A 6/1992 Fisher
11,613,385 B2 * 3/2023 Russell ..... B64D 5/00 244/171.3
11,724,824 B2 * 8/2023 Russell ..... F42B 12/66 244/171.3
2014/0260930 A1 9/2014 Russell
(Continued)

OTHER PUBLICATIONS

Rodriquez, Kari, "International Preliminary Report on Patentability dated Jan. 9, 2025", Patent Cooperation Treaty Application No. PCT/US23/69129, Patent Cooperation Treaty, Jan. 9, 2025.
(Continued)

*Primary Examiner* — Jonathan C Weber
(74) *Attorney, Agent, or Firm* — Lindauer Law, PLLC

(57) ABSTRACT

Dynamic ram accelerator operation permits operation with lower acceleration, permitting launch of acceleration sensitive payloads such as crewed vehicles. Operational cost is reduced, and reliability improved, by reducing or eliminating internal consumable parts. Relative motion between a projectile and propellant at entry to the ram accelerator enables initial ram combustion at relatively lower velocity. Valves may maintain separation between sections within the ram accelerator that contain different propellant compositions. Timing of valve opening and closing is coordinated to provide conditions suitable for ram combustion. Control over propagation speed of propellant within the system may be obtained using one or more of baffle shape, baffle spacing, propellant temperature, propellant pressure, propellant mixture, temperature of components such as baffles, and so forth. Before the projectile is launched, internal separators between sections are removed, providing an open path to the ram accelerator exit.

22 Claims, 8 Drawing Sheets

(56) References Cited

U.S. PATENT DOCUMENTS

| | | | | |
|---|---|---|---|---|
| 2015/0330147 | A1* | 11/2015 | Russell | F41A 1/04 89/7 |
| 2016/0356087 | A1* | 12/2016 | Russell | E21B 7/007 |
| 2017/0130531 | A1* | 5/2017 | Russell | F42B 12/06 |
| 2017/0307313 | A1* | 10/2017 | Knowlen | F41A 1/02 |
| 2018/0362191 | A1 | 12/2018 | Russell | |
| 2020/0031500 | A1* | 1/2020 | Russell | B64G 1/646 |

OTHER PUBLICATIONS

Knowlen, et al., "Ram Accelerator as an Impulsive Space Launcher: Assessment of Technical Risks", Presented at International Space Development Conference, Dallas TX, May 25-28, 2007, 21 pgs.

Mcfall, et al., "Numerical Analysis of Zero Velocity Start Technique for the Ram Accelerator", Aerospace and Energetics research Program, University of Washington, 1996, 11 pgs.

Rodriquez, Kari, "Patent Cooperation Treaty International Search Report and Written Opinion dated Oct. 11, 2023", Patent Cooperation Treaty Application Number PCT/US23/69129, Patent Cooperation Treaty, Oct. 11, 2023.

* cited by examiner

DYNAMIC RAM ACCELERATOR SYSTEM

PRIORITY

This application claims priority to, and the benefit of, U.S. Provisional Patent Application Ser. No. 63/367,096 filed on 27 Jun. 2022, titled "DYNAMIC RAM ACCELERATOR SYSTEM", the contents of which are hereby incorporated by reference into the present disclosure.

This application claims priority to, and the benefit of, U.S. Provisional Patent Application Ser. No. 63/367,188 filed on 28 Jun. 2022, titled "RAM ACCELERATOR SYSTEM", the contents of which are hereby incorporated by reference into the present disclosure.

COMPUTER PROGRAM LISTING APPENDIX

This disclosure incorporates by reference the material submitted in the Computer Program Listing Appendix filed herewith. The material within the Computer Progra1m Listing Appendix is Copyright 2022 to Mark Russell, all rights reserved. The Computer Program Listing Appendix is expressed in the GNU Octave language as promulgated at gnu.org/software/octave.

BACKGROUND

Traditional ram accelerators have limited operational regimes that constrain operation. These constraints have precluded various operations such as delivering payloads that are sensitive to high shock accelerations, such as passengers and satellites.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features. The figures are not necessarily drawn to scale, and in some figures, the proportions or other aspects may be exaggerated to facilitate comprehension of particular aspects.

For ease of discussion, and not necessarily as a limitation unless otherwise indicated, "upstream" refers to a direction away from the exit of the ram accelerator while "downstream" refers to a direction towards the exit of the ram accelerator system.

For ease of discussion, and not necessarily as a limitation unless otherwise indicated, a section separator mechanism that provides a barrier to movement of a gas between sections may be referred to as a "valve". In some implementations the valve may be reusable, such as with a ball valve, clamshell valve, gate valve, and so forth. In other implementations the valve may comprise a frangible diaphragm (stationary or moveable) or single-use device. Valves may be mechanically, pneumatically, electrically, magnetically, chemically, pyrotechnically, and otherwise operated.

Figure 1:
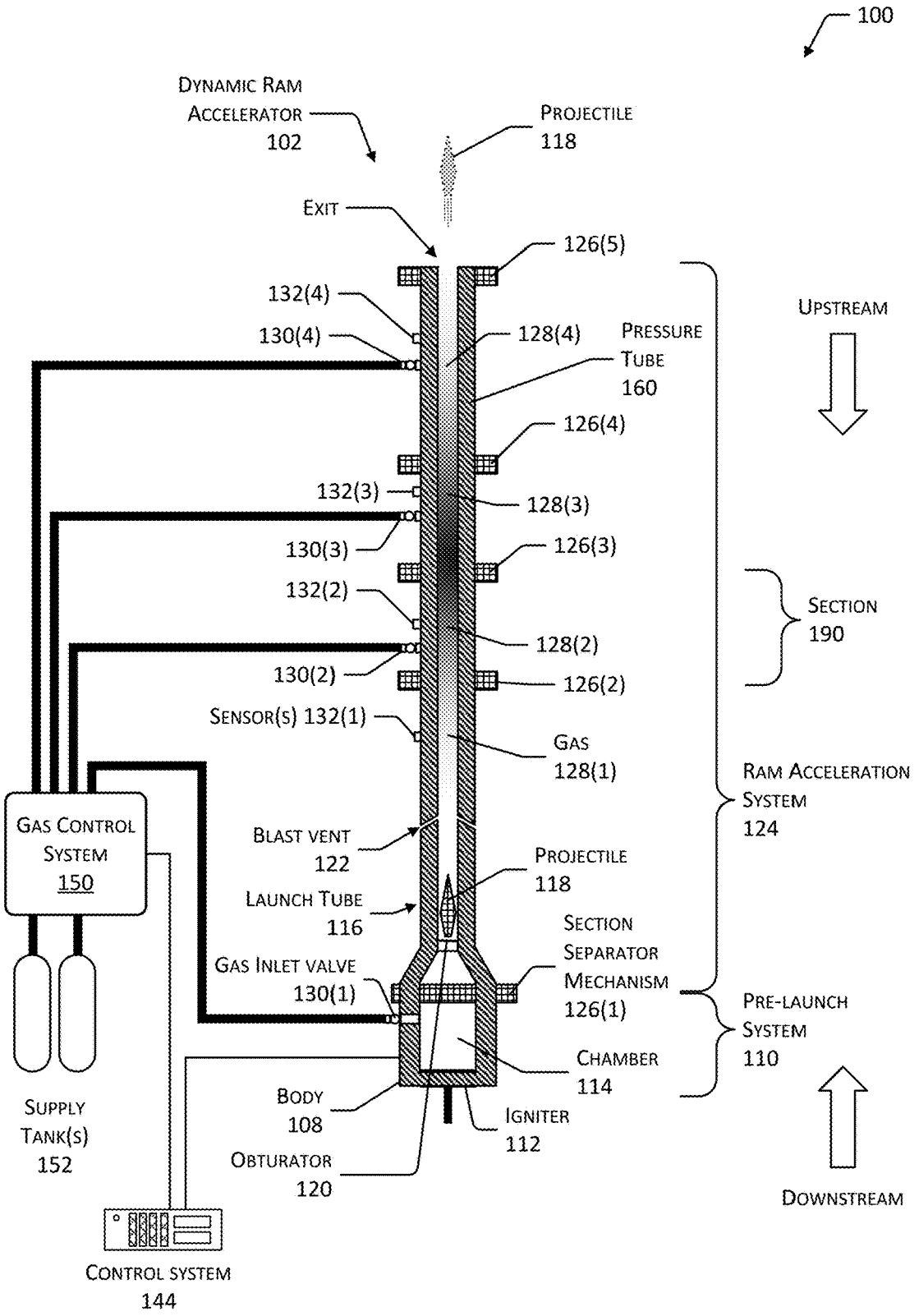

FIG. 1 illustrates a dynamic ram accelerator system, according to some implementations.

Figure 2:
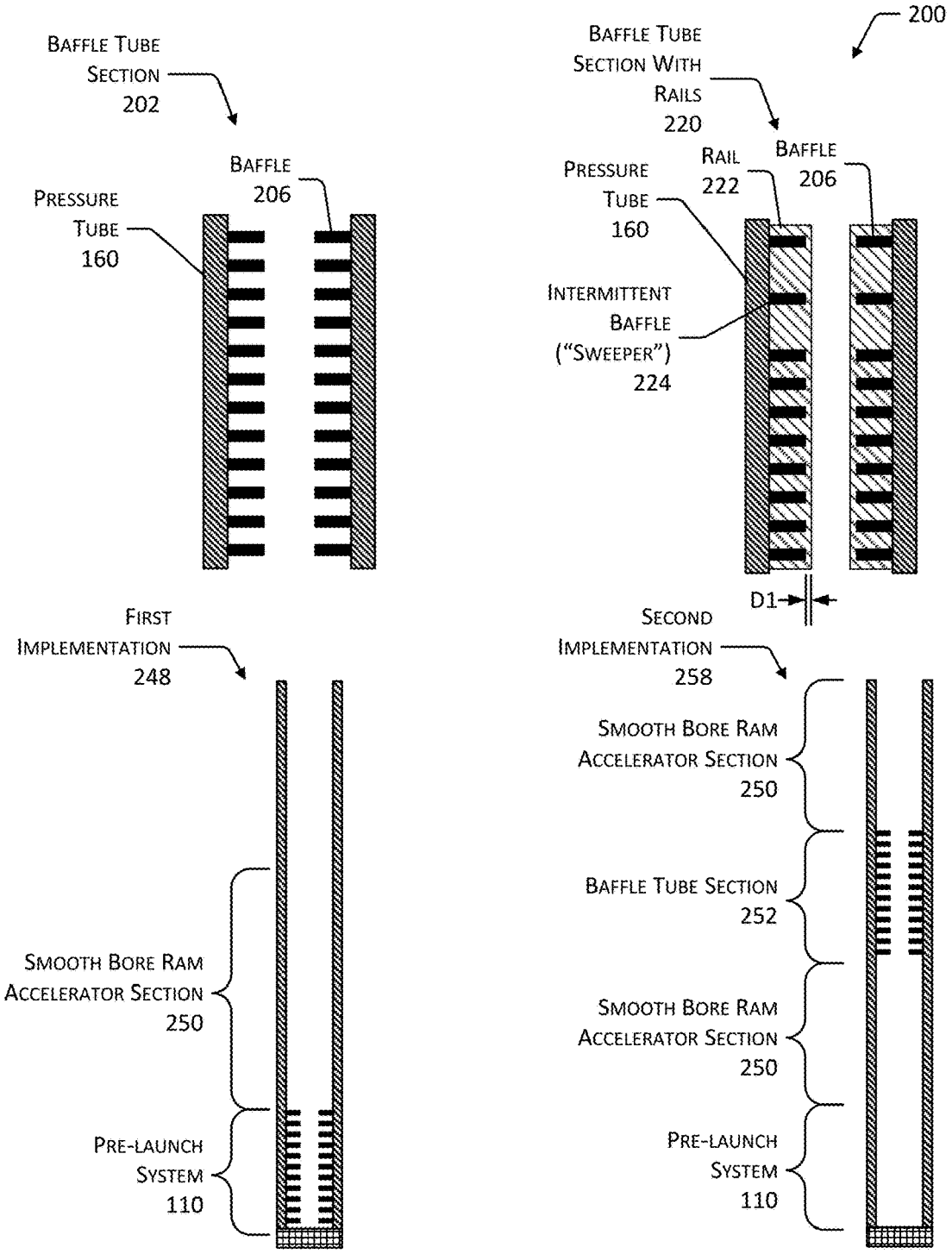

FIG. 2 illustrates some portions of a dynamic ram accelerator, according to some implementations.

Figure 3:
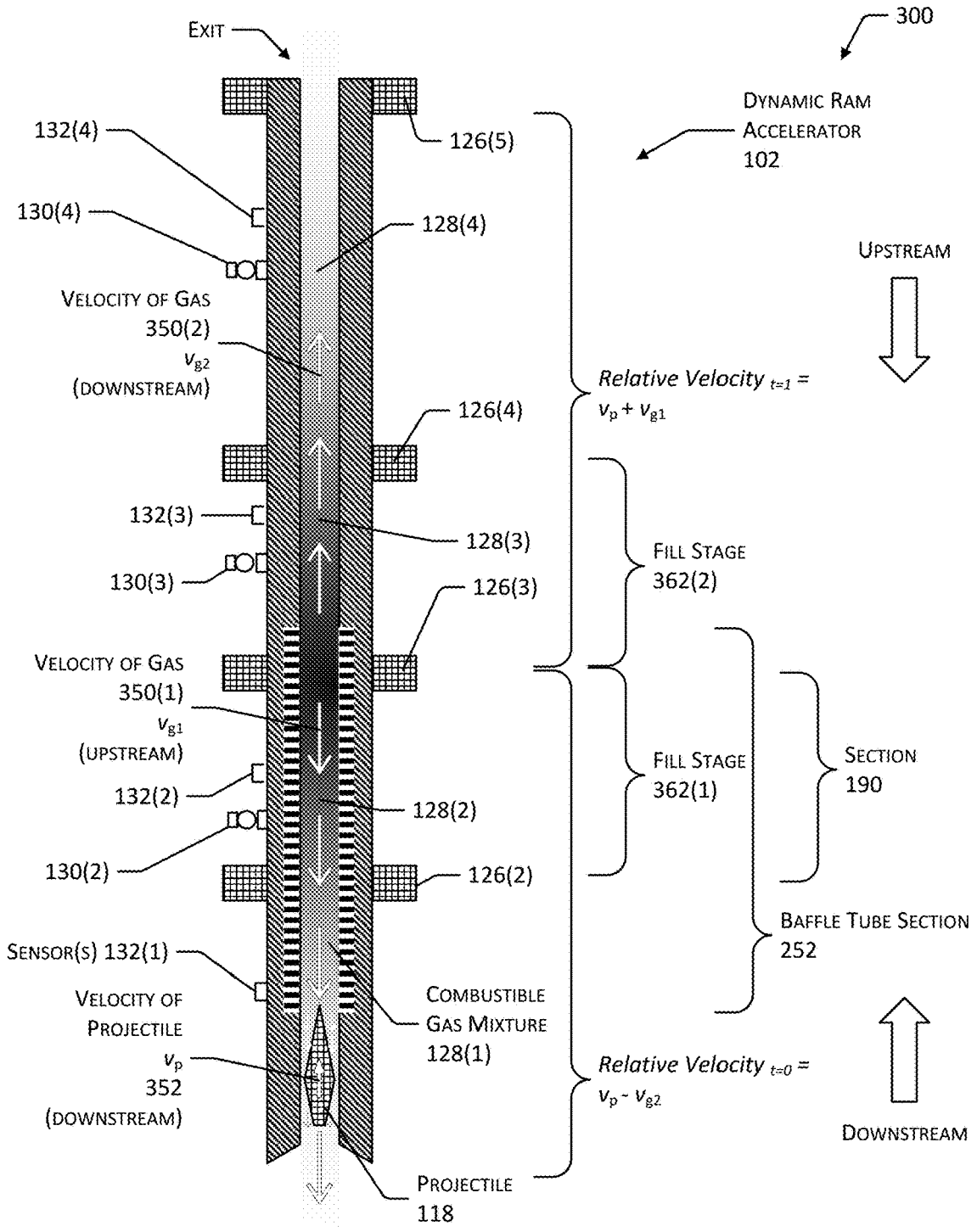

FIG. 3 illustrates an enlarged view of a portion of a dynamic ram accelerator and the relative velocity between gas flow and projectile at various portions, according to some implementations.

Figure 4:
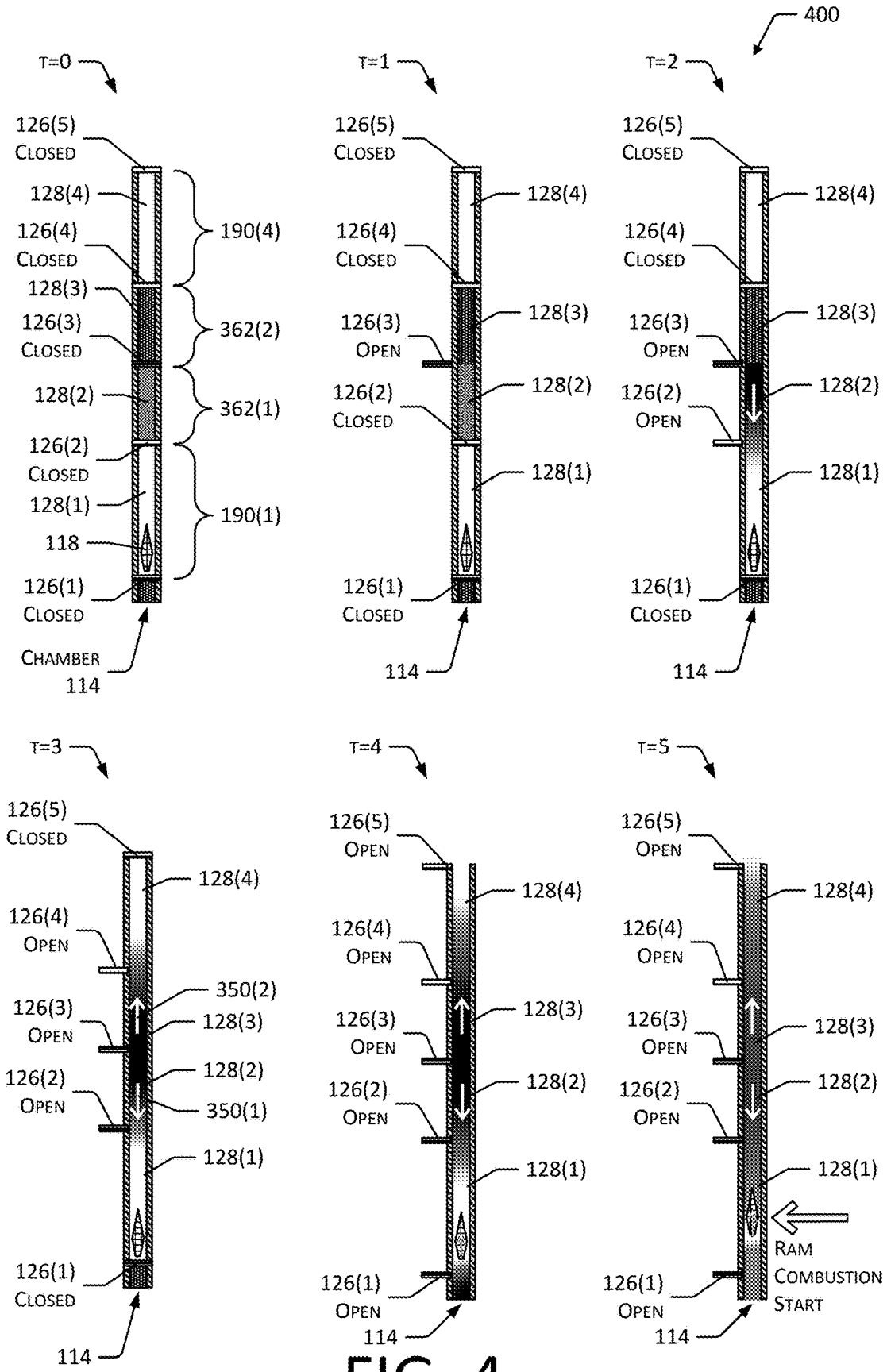

FIG. 4 illustrates a first implementation of operation of a dynamic ram accelerator system.

Figure 5:
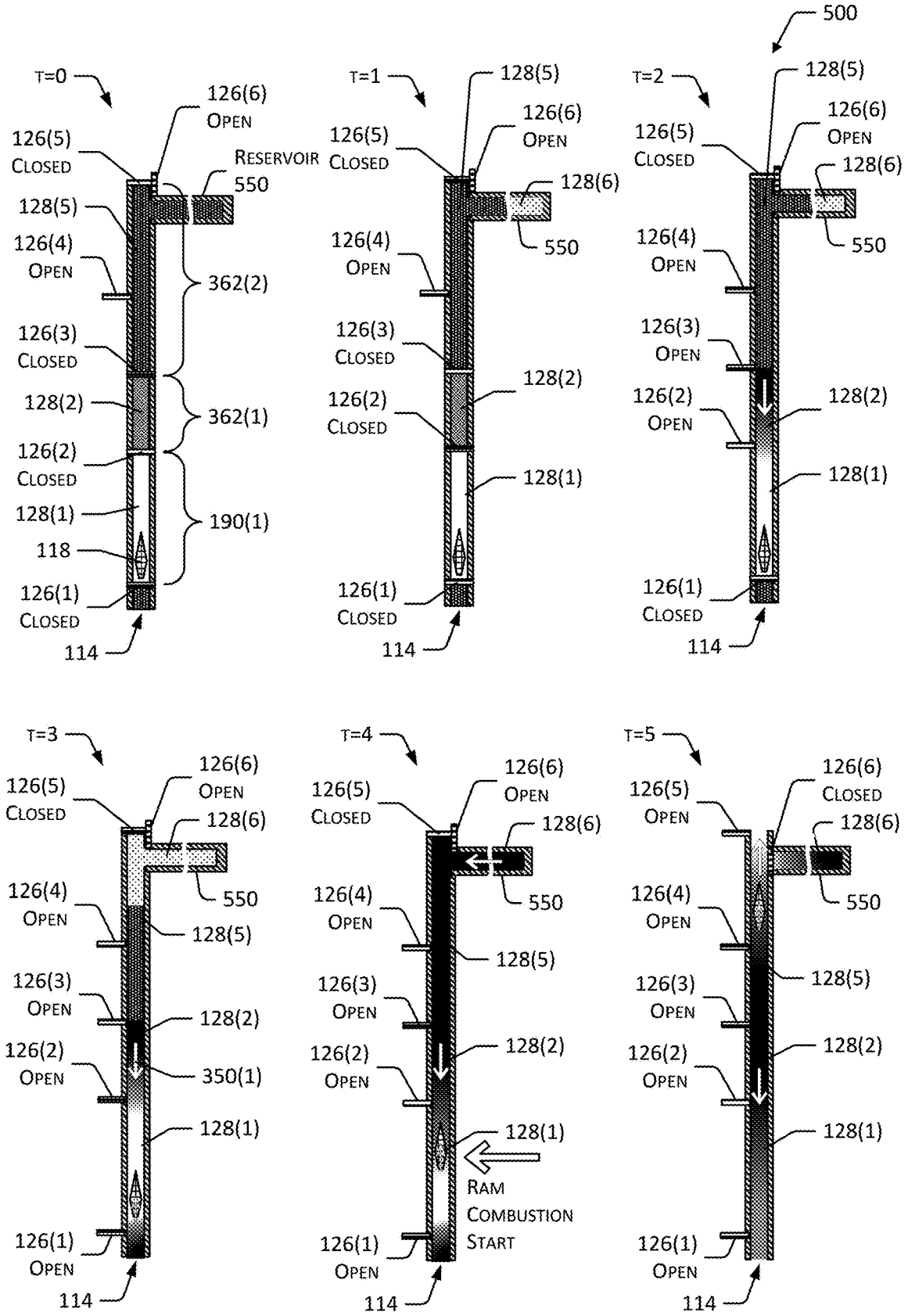

FIG. 5 illustrates a second implementation of operation of a dynamic ram accelerator system with one or more additional gas reservoirs.

Figure 6:
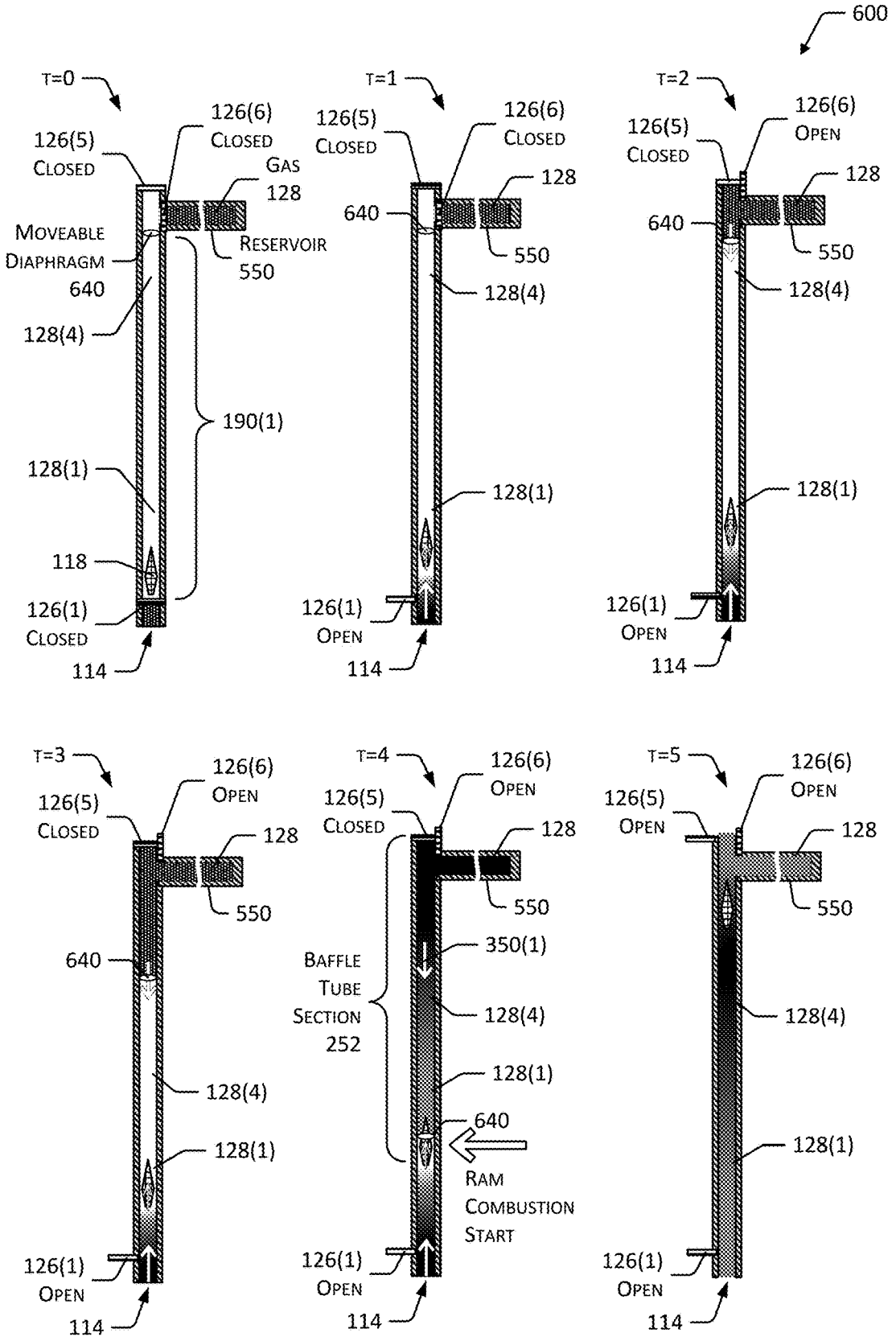

FIG. 6 illustrates a third implementation of operation of a dynamic ram accelerator system with a moveable diaphragm.

Figure 7:
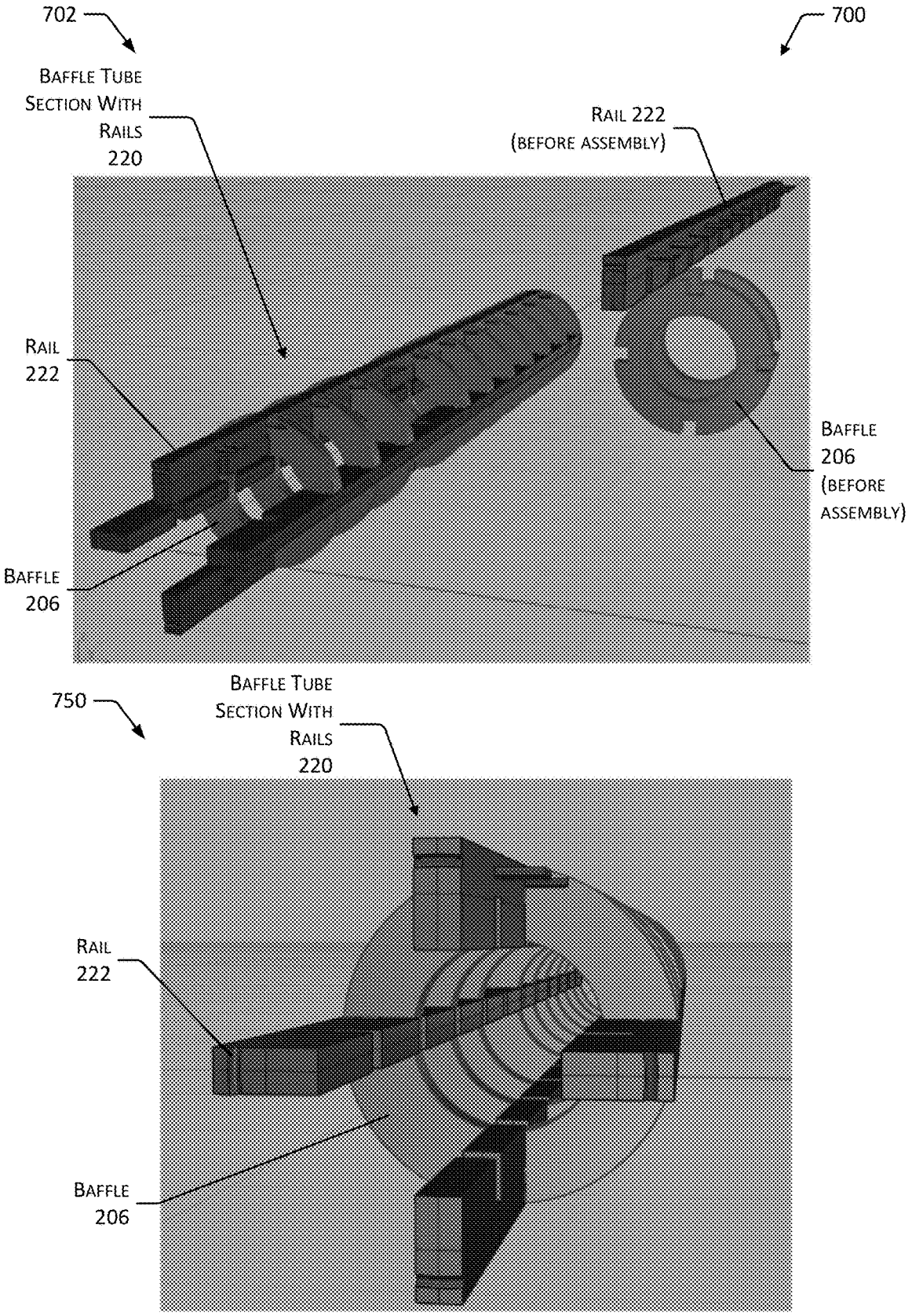
Figure 8:
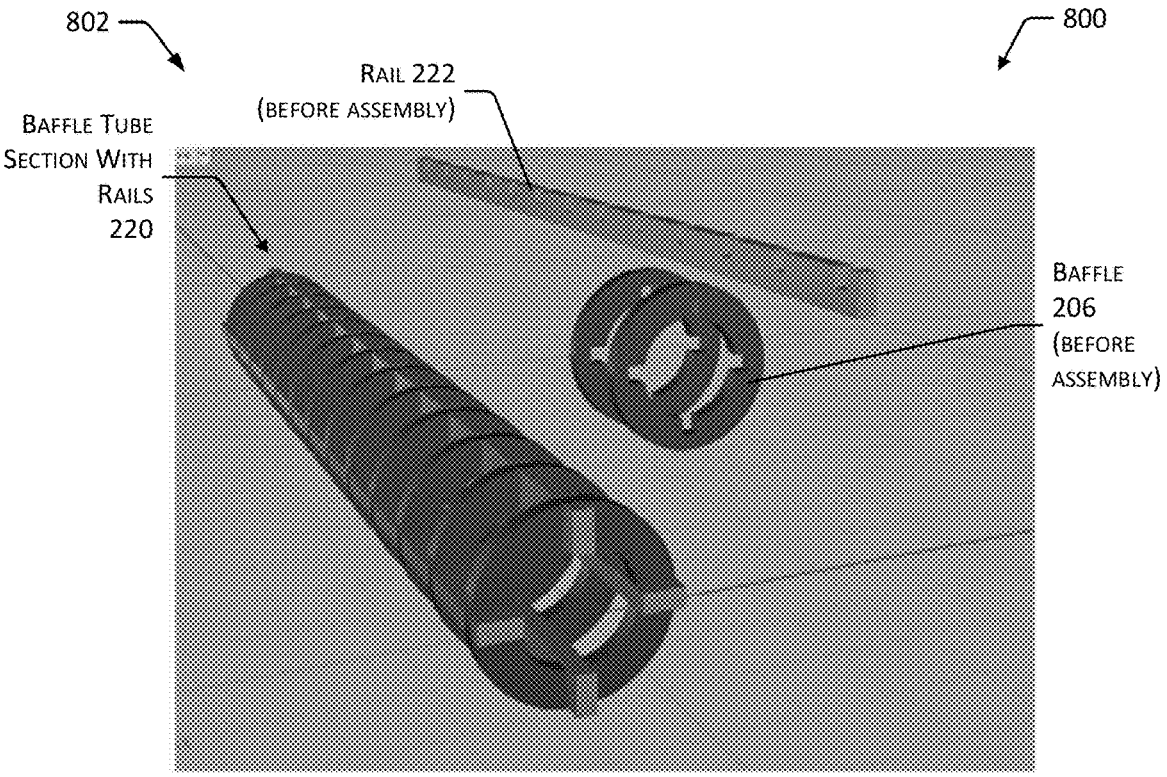
Figure 8:
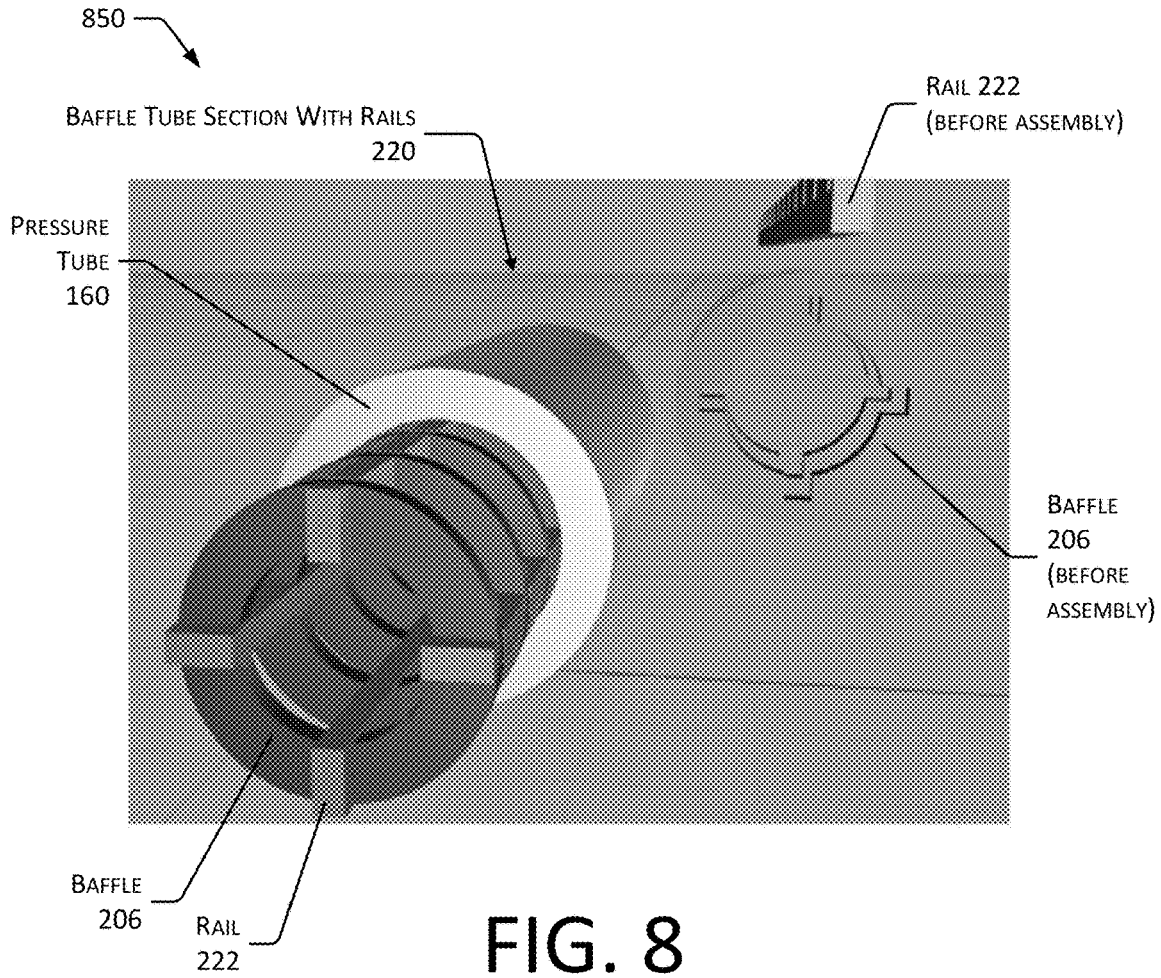

FIGS. 7-8 depict implementations of a baffle tube section with rails, according to some implementations.

While implementations are described herein by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

A ram accelerator is used to accelerate a projectile. This projectile may comprise an inert object, or a payload such as a vehicle. For example, the payload may comprise a space vehicle that is crewed or uncrewed. Some payloads are sensitive to high accelerations, such as satellites or human crew and passengers. To provide sufficient velocity to enter orbit, traditional ram accelerator designs would impose accelerations too great causing damage to these sensitive payloads.

A ram accelerator operates with a projectile having an initial velocity relative to the gas it is moving through. The gas may comprise a single gas or a mixture of different gases. At the ram accelerator initial velocity, the gas is compressed, initiating and sustaining ram acceleration through chemical combustion of the gas. A pre-launch system may be used that accelerates the projectile to the initial velocity at insertion into the ram accelerator. However, traditional techniques may result in accelerations during pre-launch that exceed the limits of sensitive payloads. Additionally, existing ram accelerator systems may also result in acceleration that exceeds the limits of a sensitive payload.

Traditional ram accelerator systems involve a pre-launch stage comprised of a start gun typically with a breech source and launch tube combination that uses constant or variable area cold gas pressure, combustion, detonation, electric rail, rotational/centripetal acceleration coil gun, and so forth. The ram accelerator stages may be railed, baffle tube, smooth bore using finned projectiles, and so forth. A substantially low-pressure "evacuated" section in the launch tube between the breech and the start of the first ram accelerator stage allows the projectile to encounter low air resistance, reducing pressure and momentum losses against the projectile which allows the start gun to achieve the minimum initial velocity of the projectile necessary for successful ram accelerator operation.

Traditional systems have also relied upon fixed frangible diaphragms to separate and pressurize gases in different stages. This has resulted in time-intensive operations to change out the diaphragm between uses, and has resulted in fouling of the ram accelerator with debris from these diaphragms. Replacement, cleaning, and other operations to make ready are time consuming, costly, and may be impractical in situations where at least part of the ram accelerator is inaccessible. For example, if the ram accelerator is constructed underground, access to a fouled portion may be limited.

Described in this disclosure are systems and techniques for dynamic operation of a system comprising the pre-launcher section and multiple ram accelerator sections. These techniques allow for control over the velocity of the projectile and control over a relative velocity of gas past the projectile. In one implementation, controlled pressurization and release of gas at particular times and in a particular sequence results in the projectile entering the ram accelerator system when the gas is rushing towards the projectile. The initial velocity is attained by a combination of the projectile velocity plus the relative motion of the gas in the opposite direction. In another implementation, controlled pressurization and release may enable ram acceleration to start with the projectile at zero velocity.

The systems and techniques in this disclosure reduce or eliminate the need for the use of diaphragms or other consumable components. This reduces the overall cost, increases launch frequency, and eliminates the need to mitigate fouling of the interior of the ram accelerator due to debris from those consumable components. For example, the system described may utilize valves that are operable to open and close. This provides a substantial operational and safety benefit: in addition to being reusable, the system may be operated such that all valves are open before the projectile begins moving. This eliminates the risk of the projectile inadvertently striking a valve that is not fully opened, providing a crucial safety advantage.

In some implementations an exit diaphragm may separate an exit of the ram accelerator from the surrounding environment. In this implementation, the projectile exits the ram accelerator by penetrating the exit diaphragm. As the exit diaphragm is at the end of the ram accelerator, debris from the exit diaphragm is shed outward, avoiding fouling of the ram accelerator.

Also described in this disclosure are techniques for further controlling the relative velocity between the projectile and the surrounding gas. As described above, one implementation lowers the velocity requirements of the projectile upon exit from the pre-launch system by using a relative motion of the gas towards the projectile, reaching the initial velocity for ram combustion to begin. Propagation of the gas may also be controlled to facilitate transition between different gas mixtures and further improve efficiency and may also smooth out acceleration. For example, a portion of the ram accelerator may be operated to produce a relative velocity of the gas in the same direction as the projectile, reducing the relative velocity of the projectile with respect to the surrounding gas. While still above the initial velocity, the relative velocity is lowered resulting in improved efficiency.

In some implementations hydrostatic pressure at an exit end of a ram accelerator or drift tube stage may be used to limit movement of materials between the interior of the ram accelerator and the exterior environment. For example, at least a portion of the pressurized gas that is released towards the projectile to produce the relative motion mentioned above may also be released towards an exit end of the ram accelerator, producing pressure on materials such as contaminants, water, and so forth that are at least partially within the exit end of the ram accelerator. This pressure would displace the materials from the exit tube before the arrival of the projectile. In some implementations the distribution of pressurized gas within the ram accelerator may be asymmetrical. For example, one or more of a larger pressure or mass of pressurized gas may be dispensed towards the projectile than toward the exit end, or vice versa.

In some implementations, gases having different densities may be used to provide a density gradient inside the ram accelerator tube exit or drift tube. For example, the temperature of the gases, or composition may be controlled to provide a desired density gradient. This gradient may be used to modify the rate of change of acceleration, or "jerk", as the projectile transitions to high-speed exit into a denser surrounding atmosphere. This manages acceleration experienced by the projectile and associated payload.

Other implementations are also discussed herein. Different aspects of the implementations described herein may be used in different combinations.

The dynamic ram accelerator also enables a rapid launch cadence. The projectiles and the fuel mixture used during ram acceleration may be reloaded relatively quickly. Reusable valves may remove the need for consumable diaphragms within the ram accelerator. The operation of the dynamic ram accelerator is inherently safe in that all reusable valves may be opened before the initiation of the ram acceleration, ensuring the projectile is unobstructed from exiting.

By using the system and techniques described in this disclosure, a dynamic ram accelerator may be used to launch a projectile at lower or zero initial velocity, and provide a smoother acceleration over time and lower transient accelerations compared to a conventional ram accelerator. As a result, more sensitive payloads may be included in the projectile. For example, human passengers, delicate mechanisms, and so forth may be included in the projectile. As a result, it is now feasible to launch such payloads on a suborbital or orbital trajectory. For example, the dynamic ram accelerator may be used to launch a projectile comprising a crewed space vehicle on a suborbital trajectory. A boost or "kick" rocket attached to the space vehicle, or rendezvoused with the space vehicle after launch, may then be used to place the space vehicle into orbit.

DETAILED DESCRIPTION

FIG. 1 is an illustrative system 100 comprising a dynamic ram accelerator 102. In some implementations, the dynamic ram accelerator 102 is placed above, or having at least a portion located within, a geologic material or body of water. In other implementations, the dynamic ram accelerator 102 may be a free-flying structure, such as in space. The dynamic ram accelerator 102 has a body 108. The body 108 may comprise one or more materials such as steel, carbon fiber, ceramics, and so forth.

The dynamic ram accelerator 102 includes a pre-launch system 110. The pre-launch system 110 may include one or more of a gas gun, electromagnetic launcher, solid explosive charge, liquid explosive charge, backpressure system, and so forth. The pre-launch system 110 may comprise a launch tube 116. A projectile 118 may be placed within the launch tube 116 before launch. During operation, the pre-launch system 110 may operate to accelerate a projectile 118 into the launch tube 116 of a ram acceleration system 124. In some implementations, at least a portion of the launch tube 116 within the pre-launch system 110 may be evacuated to maintain a vacuum prior to launch.

In one example depicted here the pre-launch system 110 comprises a detonation gas gun, including an igniter 112 coupled to a chamber 114. The chamber 114 may be configured to contain one or more combustible, explosive, or detonable materials which, when triggered by the igniter 112, generate an energetic reaction. The gases may include pressurized air, or inert gases. In the gas gun implementation depicted, the chamber 114 is coupled to a launch tube 116 within which the projectile 118 is placed. In some implementations, the projectile 118 may include or be adjacent to an obturator 120 configured to seal, at least temporarily, the chamber 114 from the launch tube 116. The obturator 120 may be attached, integrated but frangible, or separate from but in-contact with the projectile 118. One or more blast vents 122 may provide release of the reaction byproducts. In some implementations the launch tube 116 may be smooth, rifled, include one or more guide rails or other guide features, and so forth. The projectile 118 may include one or more features that engage the guide rails.

The launch tube 116, or portions thereof, may be maintained at a pressure which is lower than that of standard atmosphere. For example, portions of the launch tube 116 such as those in the pre-launch system 110 may be evacuated to a pressure of less than 25 torr.

The pre-launch system 110 is configured to initiate a ram effect with the projectile 118 in conjunction with a relative velocity differential of one or more combustible gases flowing past the projectile 118. The ram effect results in compression of one or more combustible gases by interaction with surfaces of the projectile 118 and subsequent combustion proximate to a back (aft) side of the projectile 118. This compression results in heating of the one or more combustible gases, triggering or sustaining ignition. The ignited gases combusting in an exothermic reaction impart an impulse on the projectile 118 which is accelerated down the launch tube 116. In some implementations ignition may be assisted or initiated using a pyrotechnic igniter. The pyrotechnic igniter may either be affixed to or a portion of the projectile 118, or may be arranged within the launch tube 116.

The pre-launch system 110 may use an electromagnetic, solid explosive charge, liquid explosive charge, stored compressed gases, and so forth to propel the projectile 118 from rest along the launch tube 116 to achieve the initial ram velocity.

In some implementations the one or more combustible gases may move past a stationary projectile 118, producing the ram effect in an initially stationary projectile 118. For example, the combustible gas mixture under high pressure may be exhausted past the projectile 118 as it rests within the launch tube 116. This relative velocity difference achieves the ram velocity from a zero velocity projectile 118, and the ram effect of combustion begins and pushes the projectile 118 down the launch tube 116. Hybrid systems may also be used, in which the projectile 118 is moved using the pre-launch system 110 and relative velocity of gas flowing towards the projectile 118 simultaneously.

The projectile 118 passes along the launch tube 116 from the pre-launch system 110 into a ram acceleration system 124 comprising one or more sections 190. Each section 190 may be bounded by section separator mechanisms 126. The section separator mechanism 126 provides a barrier to movement of gases between sections 190 which allows for the tailoring of the acceleration profile of the projectile 118 as it transits through the ram accelerator system 124. For ease of discussion and not as a limitation, the section separator mechanism 126 may be referred to as a "valve". In some implementations the valve may be reusable, such as with a ball valve, clamshell valve, gate valve, and so forth. In other implementations the valve may comprise a diaphragm or single-use device. Valves may be mechanical, pneumatic, electrical, magnetic, chemical, pyrotechnical, and so forth.

The section separator mechanisms 126 may include valves such as ball valves, diaphragms, gravity gradient, liquids, or other structures or materials configured to maintain the different mixtures of combustible gas 128 substantially within their respective sections 190.

A gas 128 may be admitted into a respective section via one or more gas inlet valves 130 associated with the particular section 190. Each of the different sections 190 may have a different gas 128, mixture of gas 128, gas 128 at different temperatures, and so forth.

The gas 128 may include one or more combustible gases, combustible materials in suspension within the gas, diluents, and so forth. The one or more combustible gases may include an oxidizer or an oxidizing agent. For example, the gas 128 may include hydrogen and oxygen gas in a ratio of 2:1 and may include an inert gas such as nitrogen, carbon dioxide, or helium. In other examples, the gas 128 may comprise methane and oxygen, methane and ambient air, propane and oxygen, and so forth. Other combustible gas 128 mixtures may be diluted with non-combustible gases such as silane and carbon dioxide. In some implementations a gas and a solid may be used. For example, the gas 128 may comprise a gaseous oxidizer with suspended fuel particles such as jet-A or diesel, a gaseous fuel with suspended oxidizer particles, and so forth.

The gas 128 may be provided by extraction from ambient atmosphere, electrolysis of a material such as water, from a solid or liquid gas generator using solid materials which react chemically to release a combustible gas, from a previously stored gas or liquid, and so forth.

The mixture of gas 128 used may be the same or may differ between the sections 190. These differences include chemical composition, pressure, temperature, and so forth. For example, the density of the gas 128 in each of the sections 190(1)-(4) may decrease along the launch tube 116, such that the section 190(1) holds the gas 128 at a higher pressure than the section 190(4). In another example, the gas 128(1) in the section 190(1) may comprise oxygen and propane while the gas 128(3) may comprise oxygen and hydrogen.

In this illustration four sections 190(1)-(4) are depicted, as maintained by five section separator mechanisms 126(1)-(5). When ready for operation, some of the sections 190 may be selectively filled with gas 128, while others are evacuated. While four sections 190(1)-(4) are depicted, in other implementations, different numbers of sections 190, section separator mechanisms 126, and so forth may be used. The system 100 may also include additional components not depicted in FIG. 1, such as reservoirs. Reservoirs are discussed in more detail with regard to FIG. 5.

One or more sensors 132 may be configured at one or more positions along the dynamic ram accelerator 102. These sensors may include pressure sensors, chemical sensors, density sensors, fatigue sensors, strain gauges, velocity sensors, accelerometers, proximity sensors, and so forth.

The dynamic ram accelerator 102 is configured to eject the projectile 118 from an exit or ejection end. In some implementations the exit may be closed by a section separator mechanism 126 that is reusable, such as a ball valve that is opened before passage of the projectile 118, or a consumable diaphragm that is broken before or penetrated by the projectile 118 which exits the system and emerges into the surrounding environment at supersonic or hypersonic velocity.

During normal operation, the dynamic ram accelerator 102 may accelerate the projectile 118 to a hypervelocity. As used in this disclosure, hypervelocity includes velocities greater than or equal to two kilometers per second upon ejection or exit from the dynamic ram accelerator 102.

In other implementations, the projectile may accelerate to a non-hypervelocity. Non-hypervelocity includes velocities below two kilometers per second. Hypervelocity and non-hypervelocity may also be characterized based on interaction of the projectile 118 with the surrounding material. For example, given a relative velocity between the gas 128 and the projectile 118 the projectile 118 operates at hypervelocity with ram combustion while the absolute velocity of the projectile 118 with respect to the stationary pressure tube 160 is non-hypervelocity. The pressure tube 160 comprises a structure that maintains the ram combustion reaction and resulting stresses.

For ease of discussion, and not necessarily as a limitation unless otherwise indicated, as shown in this figure "upstream" refers to a direction along a longitudinal axis of the dynamic ram accelerator 102 away from the exit of the dynamic ram accelerator 102 while "downstream" refers to a direction along this axis towards the exit of the dynamic ram accelerator 102.

A gas control system 150 comprises one or more of valves, sensors, metering devices, gas mixing devices, and other equipment to dispense gas to one or more sections 190 for operation. In some implementations the gas control system 150 may include one or more of heating or refrigeration equipment to heat or cool the gas 128 to a specified temperature. The gas control system 150 is in communication with a control system 144. The gas control system 150 is connected via one or more passages, such as pipes, to supply tanks 152 or other sources of requisite gases for operation. The gas control system 150 is also connected via one or more passages, such as pipes, to gas inlet valves 130(1), . . . , (N). In some circumstances the gas control system 150 may perform additional functions, such as evacuating a section 190 to a reduced pressure, removing gas 128 from the dynamic ram accelerator 102 following an abort, and so forth.

A control system 144 may be coupled to one or more of the dynamic ram accelerator 102, the gas control system 150, and so forth. The control system 144 may comprise one or more processors, memory, interfaces, and so forth which are configured to facilitate operation of the dynamic ram accelerator 102. The control system 144 may couple to the one or more section separator mechanisms 126, the gas inlet valves 130, and the sensors 132 to coordinate the configuration of the dynamic ram accelerator 102 for launch of the projectile 118. For example, responsive to a control input specifying a desired trajectory at exit and given a specified mass and shape of the projectile 118, the control system 144 may operate the gas control system 150 to fill a particular mixture of gas 128 into one or more sections 190.

During operation the control system 144 operates the gas control system 150 to selectively pressurize one or more portions of the dynamic ram accelerator 102. For example, one or more sections 190 that are downstream of the projectile 118 before launch may be pressurized. During the launch sequence one or more of the section separator mechanisms 126 are opened, permitting at least a portion of the gas 128 in that pressurized section 190 to be released and flow towards the projectile 118. This results in a relative velocity difference between the projectile 118 and the onrushing gas 128. As a result, ram combustion may be initiated and maintained with the projectile 118 at a much lower velocity measured with respect to a stationary object, such as the pressure tube 160. Various aspects of this dynamic flow operation are discussed with respect to the following figures. In some implementations, the system 100 may be operated in a zero velocity start in which the projectile 118 remains stationary while the onrushing gas 128 produces the start conditions for the desired ram combustion.

Other mechanisms may be present which are not depicted here. For example, an ejection system may be configured to divert or otherwise remove the projectile 118 from the dynamic ram accelerator 102 in the event of an off-nominal condition. In another example, an injection system may be configured to add one or more materials into the wake of the projectiles 118. These materials may be used to clean the launch tube 116, remove debris, and so forth.

FIG. 2 illustrates at 200 some portions of a dynamic ram accelerator 102, according to some implementations. A baffle tube section 202 comprises a plurality of baffles 206. In some implementations baffles 206 may be fabricated from a solid block of suitable material, such as steel. Monolithic segments (one or more baffles 206) are stacked together forming the sequence of baffles 206. A variable baffle may be used for low-speed start operations such as described herein.

A baffle tube section with rails 220 is also shown. In some implementations one or more rails 222 may be mounted proximate to or within the baffles 206. The rails 220 may be used to maintain alignment of the projectile 118 during passage through the dynamic ram accelerator 102.

In a first implementation 248 a pre-launch system 110 may comprise a baffle tube section 202. For example, a zero velocity start system may utilize a baffle tube section 202 in conjunction with the relative velocity between the stationary projectile 118 and the oncoming gas 128. Downstream of the baffle tube section 202 may be a smooth bore ram accelerator section 250. The smooth bore ram accelerator section 250 may omit the baffles 206. In some implementations, the smooth bore ram accelerator section 250 may include one or more rails 222.

In a second implementation 258 the dynamic ram accelerator 102 may comprise a pre-launch system 110 that includes a smooth bore launch tube 116. Downstream of the smooth bore launch tube 116 the dynamic ram accelerator 102 may comprise a smooth bore ram accelerator section 250. Downstream of a first smooth bore ram accelerator section 250(1) is a baffle tube section 252. Downstream of the baffle tube section 252 may be a second smooth bore ram accelerator section 250(2).

Some implementations of components and construction of the baffle tube section with rails 220 are discussed in more detail with regard to FIGS. 7-8.

FIG. 3 illustrates at 300 an enlarged view of a portion of a dynamic ram accelerator 102 and the relative velocity between gas flow and projectile 118 at various portions, according to some implementations. For ease of illustration other elements of the system 100 have been omitted. A portion of the dynamic ram accelerator 102 comprises a baffle tube section 252.

In this figure, the system is shown after pressurization with gas 128 of fill stages 362(1) and 362(2), and subsequent opening of the section separator mechanisms 126. When filled, the pressure within the fill stages 362 may exceed the pressure in the immediately adjacent sections 190. When the section separator mechanism 126 between the fill stage 362 and the adjacent section 190 is opened, the pressurized gas 128 moves into the adjacent section 190 due to a pressure gradient. Movement of the gas 128 is depicted by velocity of gas $v_g$ 350. In this illustration, the velocity of gas 350 is away from the initially pressurized fill stages 362 and towards the respective ends. As a result, a first portion of gas 128 is moving upstream while a second portion of gas 128 is moving downstream.

Also shown in this figure is the projectile 118 having a non-zero velocity of projectile $v_p$ 352. For example, the pre-launch system 110 may have imparted some motion on the projectile 118 before entry into the ram acceleration system 124.

By coordinating the pressurization and release of the fill stages 362, a relative velocity between the projectile 118 and the gas 128 may be created, resulting in a ram combustion effect. This occurs while the velocity of the projectile 118, with respect to a fixed reference frame such as the pressure tube 160, is relatively low or zero.

At different locations with respect to the dynamic ram accelerator 102 this movement of the gas 128 resulting from the pressure gradient produces different relative velocities. These relative velocities may be tailored to optimize ram combustion by the projectile 118 during passage through the ram acceleration system 124. For example, at time t=0 before the projectile 118 reaches the fill stage 362(1) that is proximate to the pre-launch system 110, the projectile 118 encounters onrushing gas 128. The resulting relative velocity of the gas 128 with respect to the projectile 118 is the velocity of gas $v_{g1}$ 350(1) summed with the velocity of the projectile $v_p$ 352. As a result, ram combustion begins sooner, reducing the necessary overall length of the typical non-dynamic ram accelerator 102, requirements for the pre-launch system 110 (if any), reduction in transient accelerations, and so forth, compared to traditional non-dynamic ram accelerator operations.

Continuing the example, at time t=1, the projectile 118 (not shown) has moved farther downstream, past the first fill stage 362(1) and the region, and begins to encounter the velocity of gas 350(2) that is downstream. As a result, the resulting relative velocity of the gas 128 with respect to the projectile 118 is the difference between the velocity of gas $v_{g2}$ 350(2) and the velocity of the projectile $v_p$ 352. In some implementations this decrease in relative velocity during later passage through the dynamic ram accelerator 102 is advantageous, as it maintains the projectile 118 at a relative velocity with respect to the gas 128 that provides improved ram combustion, improving overall efficiency.

The various mathematical signs of the operations described may be varied based on the coordinate system used and associated signs indicative of direction. For example, a downstream velocity may be deemed positive while an upstream velocity is negative.

Various implementations of pressurization of fill stages 362 and release of the gases 128 contained therein may be utilized to facilitate various operations. Some implementations are discussed with regards to FIGS. 4-6.

FIGS. 4-6 depict simplified schematics of a portion of the system 100 for ease of illustration in depicting a sequence of events, and not necessarily as a limitation. Times are depicted from t=0 to t=5. These time labels are for description purposes and not by way of limitation. The actual duration of time between individual time labels may differ. For example, the duration of the interval between t=0 and t=1 may differ from the duration of the interval between time t=4 and t=5.

Shading in these figures is provided to differentiate various elements, and is not necessarily indicative of other physical parameters, such as pressure.

Unless otherwise specified, the section separator mechanisms 126 are depicted as gate valves for clarity of illustration and not necessarily as a limitation.

In some implementations, fill stages 362 may be pressurized, while sections 190 that are not used as fill stages 362 may be evacuated.

The quantity and relative arrangement of section separator mechanisms 126 are for illustration only. In other implementations the system 100 may utilize greater or lesser numbers of section separator mechanisms 126.

A projectile 118 is shown proximate to a first section separator mechanism 126 that may separate the ram acceleration system 124 from the pre-launch system 110.

FIG. 4 illustrates at 400 a first implementation of operation of a dynamic ram accelerator system 100. In this implementation, the dynamic ram accelerator 102 incorporates one or more baffle tube sections 202 (not shown).

At t=0 a first fill stage 362(1) comprising a portion of the dynamic ram accelerator 102 that is bounded by section separator mechanisms 126(2) and 126(3), that are closed, is pressurized with gas 128(2).

A second fill stage 362(2) comprising a portion of the dynamic ram accelerator 102 that is bounded by section separator mechanisms 126(3) and 126(4), that are closed, is pressurized with gas 128(3).

A first section 190(1) bounded by section separator mechanisms 126(1) and 126(2), that are closed, may be evacuated.

A fourth section 190(4) bounded by section separator mechanisms 126(4) and 126(5), that are closed, may be evacuated. The chamber 114 (or other launch mechanism) is pressurized or otherwise primed for launch. The first section 190(1) is separated from the chamber 114 by a closed first section separator mechanism 126(1). In some implementations the fourth section 190(4) may omit baffles 206.

The composition, pressure, temperature, or other parameters of the respective gas 128(2) or 128(3) may be the same or may differ.

At t=1 the section separator mechanism 126(3) is opened. If a pressure gradient exists between the first fill section 362(1) and the second fill section 362(2), one or more of the gas 128(2) or 128(3) may begin moving.

At t=2 the section separator mechanism 126(2) is opened. A first pressure differential between one or more of the first fill section 362(1) or the second fill section 362(2) relative to the first section 190(1) results in upstream movement of the gas 128 towards the projectile 118.

At t=3 the section separator mechanism 126(4) is opened. A second pressure differential between one or more of the first fill section 362(1) or the second fill section 362(2) relative to the fourth section 190(4) results in downstream movement of the gas 128 towards the exit. Meanwhile, a portion of the gas 128 continues upstream towards the projectile 118.

At t=4 the section separator mechanism 126(5) is opened, exposing the ram acceleration system 124 to the exterior environment. In other implementations, the section separator mechanism 126(5) may comprise a diaphragm or other element that is left in place and is opened before, or penetrated by, passage of the projectile 118. Portions of the gas 128 continue to proceed moving upstream and downstream, respectively.

The section separator mechanism 126(1) is opened, and the pre-launch system 110 is activated, moving the projectile 118 towards the onrushing upstream gas 128.

At t=5 the projectile 118 encounters the onrushing upstream gas 128, producing a relative velocity that is a sum of the first velocity of gas 350(1) and the velocity of the projectile 352. With this relative velocity, ram combustion may begin or be sustained. In some implementations, an initiator may be used to initiate ram combustion. For example, the projectile 118 may include a pyrotechnic flare that serves as an ignition source or controlled, timed, triggered in-tube fixed location(s) ignition (spark, pyros, and so forth) sources may initiate ram accelerator start at even lower velocities than traditional or dynamic ram accelerator without these secondary energetic ignition sources.

With ram combustion initiated, the projectile 118 accelerates downstream and exits the dynamic ram accelerator 102.

FIG. 5 illustrates at 500 a second implementation of operation of a dynamic ram accelerator system 100 with one or more additional gas reservoirs 550. The system 100 may include one or more reservoirs 550 that serve to provide additional buffering capacity of the gas 128, provide a controlled egress of gases 128 from the pressure tube 160, or other functions. The reservoir(s) 550 may store some quantity of gas 128 at a particular pressure for use during operation of the ram acceleration system 124, and have passageways sized to provide a desired flow rate of the gas 128 therein to the pressure tube 160. In some implementations the reservoir 550 may comprise one or more of the supply tanks 152.

A combustible gas pushed by an inert that by the time the projectile passes the reservoir entrance, since the gases are inert, it won't induce a detonation or an unstart condition stopping ram combustion, since it will have naturally stopped combusting and is drifting or coasting in the inerts. In the implementation depicted, a reservoir 550 is fitted to the pressure tube 160 in section 190(4), proximate to the exit. In this implementation, the dynamic ram accelerator 102 may incorporate one or more baffle tube sections 202 (not shown).

In some implementations one or more of the pressure tube 160, or the reservoir 550 may be smooth bore, baffled or otherwise shaped, and comprise a valve 126 to control the exit gas velocity. The reservoir 550 may store one or more gases with gradient or separate gases and fuel injection, as the gas enters the section 190, creating upstream flowing gas 128.

At t=0 a first fill stage 362(1) comprising a portion of the dynamic ram accelerator 102 that is bounded by section separator mechanisms 126(2) and 126(3), that are closed, is pressurized with gas 128(2).

A second fill stage 362(2) comprising a portion of the dynamic ram accelerator 102 that is bounded by section separator mechanisms 126(3) and 126(5), that are closed, and the reservoir 550 is pressurized with gas 128(5). A section separator mechanism 126(6) between the reservoir 550 and the second fill stage 362(2) is open.

In this implementation the section separator mechanism 126(4) may be omitted or remain in the open state.

A first section 190(1) bounded by section separator mechanisms 126(1) and 126(2), that are closed, may be evacuated.

The chamber 114 (or other launch mechanism) is pressurized or otherwise primed for launch. The first section 190(1) is separated from the chamber 114 by a closed first section separator mechanism 126(1).

The composition, pressure, temperature, or other parameters of the respective gas 128(2) or 128(5) may be the same or may differ.

At t=1 an additional gas 128(6) is introduced into the reservoir 550.

At t=2 the section separator mechanisms 126(2) and 126(3) are opened. A first pressure differential between one or more of the first fill section 362(1) or the second fill section 362(2) relative to the first section 190(1) results in upstream movement of the gas 128 towards the projectile 118.

At t=3 the additional gas 128(6) continues to be introduced into the reservoir 550. As a result, the gas 128(6) is proximate to the exit while a portion of the gas 128(5) is pushed upstream. Meanwhile, a portion of the gas 128 continues upstream towards the projectile 118.

The section separator mechanism 126(1) is opened, and the pre-launch system 110 is activated, moving the projectile 118 towards the onrushing upstream gas 128.

At t=4 the projectile 118 encounters the onrushing upstream gas 128, producing a relative velocity that is a sum of the first velocity of gas 350(1) and the velocity of the projectile 352. With this relative velocity, ram combustion may begin or be sustained.

At t=5 the section separator mechanism 126(6) is closed and the section separator mechanism 126(5) is opened to allow passage of the projectile 118 to exit the dynamic ram accelerator 102. With the section separator mechanism 126(5) open, a portion of the gas 128 may move downstream, into the ambient environment, respectively.

In other implementations, the section separator mechanism 126(5) may comprise a diaphragm or other element that is left in place and is opened before, or penetrated by, passage of the projectile 118.

FIG. 6 illustrates at 600 a third implementation of operation of a dynamic ram accelerator system 100 with a moveable cap or moveable diaphragm 640 or variable mass and material type to tailor acceleration and relative gas velocity and a reservoir 550. In the implementation depicted, a reservoir 550 is fitted to the pressure tube 160 proximate to the exit. In this implementation, the dynamic ram accelerator 102 may incorporate one or more baffle tube sections 202 (not shown).

At t=0 the reservoir 550 is pressurized with gas 128. The reservoir 550 is separated from the pressure tube 160 by section separator mechanism 126(6) that is closed.

In this implementation the section separator mechanisms 126(2)-(4) may be omitted or remain in the open state.

A first section 190(1) is bounded by section separator mechanisms 126(1) and 126(5) and 126(6), that are closed. The first section 190(1) may be evacuated.

Placed within the first section 190(1) is a moveable diaphragm 640. The moveable diaphragm 640 may comprise an assembly that restricts or prevents flow of gas 128 past itself but is able to move upstream along the dynamic ram accelerator 102. For example, the moveable diaphragm 640 may have a profile that is the same as, or similar to, the projectile 118.

The chamber 114 (or other launch mechanism) is pressurized or otherwise primed for launch. The first section 190(1) is separated from the chamber 114 by a closed first section separator mechanism 126(1).

At t=1 the section separator mechanism 126(1) is opened, and the pre-launch system 110 is activated, moving the projectile 118 downstream, towards the exit.

At t=2 the section separator mechanism 126(6) is opened. A first pressure differential between the reservoir 550 relative to the first section 190(1) results in gas 128 and the moveable diaphragm 640 being displaced upstream, towards the oncoming projectile 118.

At t=3 the gas 128 and the moveable diaphragm 640 continue moving upstream, and the projectile 118 continues moving downstream towards the exit.

At t=4 the projectile 118 enters a baffle tube section 252 and encounters the onrushing moveable diaphragm 640 and gas 128. The moveable diaphragm 640 is penetrated by the projectile 118, or the moveable diaphragm 640 may be destroyed before encountering the projectile 118. With the encounter between the projectile 118 and the onrushing gas 128 producing the relative velocity, ram combustion starts.

At t=5 the section separator mechanism 126(5) is opened to allow passage of the projectile 118 to exit the dynamic ram accelerator 102. With the section separator mechanism 126(5) open, a portion of the gas 128 may move downstream, into the ambient environment, respectively. In some implementations, the section separator mechanism 126(6) is closed before passage of the projectile 118.

In other implementations, the section separator mechanism 126(5) may comprise a diaphragm or other element that is left in place and is opened before, or penetrated by, passage of the projectile 118.

Additional Description of Implementations

First Implementation

A first implementation utilizes an evacuated launch tube 116. A first section of the ram acceleration system 124 is evacuated to a low pressure, while a second section "fill stage" is filled above desired operational pressure. A closed valve maintains the gas in the fill stage 362 until opened. The fill stage 362 acts as a gas supply that flows upstream into the evacuated section of the ram acceleration system 124 section once the valve is opened. The timing of the opening of the breech valve or other pre-launch system element and the valve of the fill stage 362 may be synchronized or sequenced with the timing of the start of projectile 118 movement to optimize velocity and position of the projectile 118 as it comes into contact with the ram acceleration system 124 gases 128 at a pressure that is efficient for ram acceleration system 124 combustion. The upstream flowing gases 128 meet with the downstream projectile 118 in the ram acceleration system 124 to provide a relative velocity for combustion start and operation. For long ram acceleration system 124 sections this method is particularly efficient because the projectile 118 may remain stationary until the fill stage valve (and other valves in some implementation) are fully open due to the time of gas transit through the ram accelerator sections downstream of the projectile.

The use of two fill stages 362 provides different sections of gas 128 to move in different (opposite) relative velocities. As a result, as the projectile 118 enters the gases 128 released from the first fill stage 362, the relative velocity between the projectile 118 and the oncoming (upstream) gases 128 is increased. This allows the projectile 118 to achieve initial velocity at a lower absolute velocity with respect to the ram acceleration system 124 structure. In comparison, as the projectile 118 travels downstream, it encounters the downstream gases 128 released from the second fill stage 362. These gases 128 are travelling in the same direction as the projectile 118, reducing the relative velocity. While still above the initial velocity, this reduction in relative velocity maintains the projectile 118 within a desired range of thrust coefficients. (See C. Knowlen, et al, "Dynamic ram acceleration system 124 as an Impulsive Space Launcher: Assessment of Technical Risks", FIG. 6.) This may also facilitate the use of the same gas mixture 128 between adjacent sections. For example, the projectile 118 may first encounter a first gas mixture 128 from the first fill stage 362, and then encounter the same first gas mixture 128 in the second fill stage 362, while maintaining the desired thrust coefficient. The projectile 118 may then move into a third section using a second gas mixture 128 having an upstream velocity, a fourth section using the second gas mixture 128 having a downstream velocity, and so forth.

The pre-launch system 110 may include a breech valve that is operable to provide an opening with a time-variable cross-sectional area or staged injections between the launch gas system and the launch tube 116. This allows for a variable flow rate of gases 128 from the pre-launch system 110 into the ram acceleration system 124 and allowing controlled acceleration of the projectile 118.

The first implementation may omit the use of any internal consumable elements, such as diaphragms. In one implementation an exit diaphragm or exit valve may be used to permit the projectile 118 to pass into the surrounding environment.

Second Implementation

A second implementation is a variation of the first implementation, where a valve in the ram acceleration system 124 is open or opens and allows the ram acceleration system 124 sections and the launch tube 116 to equalize in pressure. The ram acceleration system 124 and launch tube 116 are filled to a target pressure below the intended operational pressure of the ram acceleration system 124. The start gun or other element of the pre-launch system 110 pushes the projectile 118 while the projectile 118 pushes the upstream gases 128 ahead of the projectile 118. The upstream gases 128 are at a substantial, but significantly lower pressure than the breech and launch tube 116, allowing projectile 118 acceleration and high velocity. An optional active or passive vent system at the launch tube 116 to ram section interface may vent out the gases 128 being pushed by the projectile 118. As the projectile 118 enters the ram acceleration system 124 stage, an area change occurs. For example, the launch tube 116 has a smaller inner diameter than the ram acceleration system 124. This transition in cross-sectional area results in a decrease in the pressure of the gases 128 being pushed by the projectile 118. Additionally, the relative velocity between the gas 128 and the projectile 118 produces the initial velocity. As a result of the local pressure decrease resulting from the change in cross sectional area, the launch tube 116 gases 128 are provided with a volume into which to expand and slow-down, thus enabling a ram effect start for combustion. In a system having a relatively short overall length, this may reduce the opening velocity requirement of or eliminate all-together the need for the upstream ram valve.

In some implementations the launch tube 116 may be filled with a different gas 128 than the ram section, for example air instead of methane-air, to prevent any unintended initiation of combustion ahead of the projectile 118. For example, unintended combustion ahead of the projectile 118 may result from gas blow-by around the projectile 118, projectile 118 nose shock heating while transiting the launch tube 116, and so forth. Such unintended combustion could substantially slow the projectile 118 down with high combustion pressures and/or interfere with ram acceleration system 124 combustion.

Third Implementation

A third implementation utilizes a partial, or no, evacuation of the launch tube 116 and the pressure of the gun launch is used similar to a two-stage light gas gun in which the projectile 118 is used to increase the pressure of the gas 128 (fluid) ahead of the projectile 118. The ram acceleration system 124 geometry (volume) is well-defined ahead of the projectile 118 and Press1*Vol1=P2*Vol2 ideal gas law as a first approximation to the pressurization, shows the velocity of the projectile 118 still accelerating to a sufficient velocity for ram acceleration operations. This implementation avoids the use of any evacuation requirements on the launch tube 116, and eliminates the requirement for segmentation between the launch tube 116 and ram acceleration system 124 stage, thus simplifying construction and operations. This implementation may be used in combination with other implementations to accommodate zero velocity or lower velocity start requirements.

FIGS. 7-8 depict implementations of a baffle tube section with rails 220, according to some implementations.

FIG. 7 depicts at 700 two views of a first implementation of the baffle tube section with rails 220. At 702 a first view depicts a baffle tube section with rails 220 in assembled form, as well as examples of an unassembled rail 222 and unassembled baffles 206, with the pressure tube 160 and other elements omitted for ease of illustration, and not necessarily as a limitation. Depicted are four rails 222 and a plurality of baffles 206. Each rail 222 may include one or more engagement features, such as slots or notches. Each baffle 206 may include one or more engagement features, such as slots, notches, tabs, and so forth. In this implementation the baffle 206 comprises slots disposed along the outer circumference of the baffle 206. When assembled, the rails 222 may be joined, by at least the mechanical engagement features, to the baffles 206. In this implementation the rail notches and baffle notches are interfaced with the rail 222 inserting from the outer diameter of the baffle 206, which may produce intermittent, discontinuous rail contact with the projectile 118 while increasing the interference drag with projectile passage. This arrangement may improve overall cost efficiency and the reduced contact area of the rail-projectile interface may be minimized to reduce rail drag between the projectile 118 and the rail 222.

In some implementations, contact between the projectile 118 and the rail 222 may introduce additional drag during projectile passage. The contact area of the rail 222 to projectile interface may be minimized to further reduce this projectile to rail drag. For example, the profile or portion of the rail that comes into contact with the projectile may be rounded, grooved, knife-edged, and so forth. In some implementations a lubricant may be applied to the rails 222 prior to projectile passage.

At 750 a view of the completed assembly is shown, with the engagement features providing mechanical engagement between the rails 222 and the baffles 206. Additional forms of engagement may also be utilized, such as welding, wedges, fasteners, and so forth to join the baffles 206 to the rails 222. During passage, a gap may be present between the projectile 118 and the inner diameter of the baffles 206.

FIG. 8 depicts at 800 two views of a second implementation of the baffle tube section with rails 220. At 802 a first view depicts a baffle tube section with rails 220 in assembled form, examples of an unassembled rail 222 and unassembled baffles 206, and the pressure tube 160, with other elements omitted for ease of illustration, and not necessarily as a limitation. Depicted are four rails 222 and a plurality of baffles 206. Each rail 222 may include one or more engagement features, such as slots, notches, tabs, and so forth. Each baffle 206 may include one or more engagement features, such as slots or notches. In this implementation the baffle 206 comprises slots disposed along the inner circumference of the baffle 206. When assembled, the rails 222 may be joined, by at least the mechanical engagement features, to the baffles 206. In this implementation the rail notches and baffle notches are interfaced with the rail 222 being inserted from the inside diameter of the baffle 206. This arrangement provides continuous rail contact with the projectile 118 without the intermittent notches depicted with regard to the arrangement of FIG. 7. In some implementations, this continuous contact may introduce additional drag between the rail and projectile during projectile passage. The contact area of the rail to projectile interface may be minimized to further reduce this projectile to rail drag. For example, the profile or portion of the rail that comes into contact with the projectile may be rounded, grooved, knife-edged, and so forth. In some implementations a lubricant may be applied to the rails 222 prior to projectile 118 passage.

At 850 a view of the completed assembly is shown, with the engagement features providing mechanical engagement between the rails 222 and the baffles 206. Additional forms of engagement may also be utilized, such as welding, wedges, fasteners, and so forth to join the baffles 206 to the rails 222. During passage, a gap may be present between the projectile 118 and the inner diameter of the baffles 206.

Implementations of Ram Acceleration System Construction

A baffle tube section 202 ram acceleration system 124 (BTRA) utilizes a series of baffles 206 within the ram acceleration system 124. In some implementations baffles 206 may be fabricated from a solid block of suitable material, such as steel. Monolithic segments (one or more baffles 206) are stacked together forming the sequence of baffles 206 with a rail 222 system and inner (minor) diameter of the bore that are the same and constant with the outer tube. A variable baffle 206 may be used for low-speed start operations such as described herein.

One consideration with the use of baffles 206 is the proximity of the projectile 118 to the minor diameter of the baffle 206. A non-zero correct spacing is optimal for allowing the gases 128 and combustion processes to react against the projectile 118 to ram accelerate, while the shoulder-to-shoulder spacing of the projectile 118 and the baffle 206 and the gap create temporary high-pressure zones.

The constant separation of the gap between the projectile 118 and the baffle 206 may be provided in some implementations by the rail 222 inner dimension which may be manufactured continuous and subcaliber to the baffle 206 minor diameter. The rail 222 provides smooth passage for the projectile 118 transit, provides gap separation between the projectile 118 and the baffle 206, preventing significant canting or "balloting" of the angle of the projectile 118 while in the BTRA section. This is advantageous, as undesired canting could result in an unintended collision between the projectile 118 and the baffles 206 or other portions of the ram acceleration system 124. By using the implementation described herein, the rail 222 provides the separation as well as a continuous structural load transmission path from the baffle 206 to baffle 206 volumes resulting from combustion and other effects back to the outer pressure tube 160 interface of the ram acceleration system 124.

This allows the ram acceleration system 124 to be constructed such that the outer diameter may be varied to allow for larger area ratio for lower speed start and smaller area ratios for higher speed operations. This simplifies construction, such as tunnel boring to provide a path for the ram acceleration system 124.

The path of the ram acceleration system 124 may combine one or more curves in one or more planes. For example, the ram acceleration system 124 installed on Earth may describe a path that takes into consideration Coriolis force.

A combination of interlocking features may allow the diameter, thickness, and spacing of the baffles 206 to be tailored. This allows the volume of combustion at any point within the ram acceleration system 124 to be controlled.

The ram acceleration system 124 may include other features. For example, the ram acceleration system 124 may include one or more vents. In some implementations reverse circulation may be provided to vent around a baffle 206 and towards the projectile 118. The rails 222 may protrude past the baffle 206, allowing gas-projectile 118 gap while preventing canting.

In some implementations python or labyrinth seals may be used between different portions of the system. For example, python seals or other seals may be used to seal between baffle tube section 202 sections.

One or more fastening techniques may be used to affix a rail 222 to a baffle 206. For example, pins, bolts, wedges, welds, adhesive, mechanical interface, threaded fasteners, and so forth.

A locking wedge on or near the outer (major) diameter of the baffle 206 structurally locks the baffle 206 to the rail 222. Allowing the rail 222 to take a pinned (or fixed, etc.) bending load of the unsupported notched section of the baffle 206. The lower section of the baffle 206 is retained by a locking interface and notch in the rail 222, fully pin-supported by the inner diameter section of the rail 222. The rail 222 section with notches is assembled from the outside diameter to the inside. Tie rods may be used to connect baffles 206, assisting with beam loads. In some implementations the transport tubes may also be load bearing. This allows in manufacturing the bore dimensions to be easily maintained using a calibrated rod to set the distance between rails 222 during, welding, for example of the baffles 206 to the rails 222. This allows the rail 222 dimensions to be precisely managed. The baffles 206 (or sweepers) may be connected with one or more rails 222 that assemble self-aligning from the inside out (as FIG. 8) or outside (FIG. 7). The rails 222 and the baffles 206 may be slotted to fit puzzle-like together to share the structural loading and an inner rod will set the rail 222 spacing precisely during assembly and possibly welding/adhesion is required. Locking structure with tack welding may be sufficient to handle pressure loads on baffles 206. The rails 222 will provide that subcaliber stand-off to prevent the projectile from striking the edge of the baffle 206. The baffle 206 is a means by which the relative velocity may be controlled, and may also be used to manage drag and alignment of the projectile 118 relative to the baffle 206.

In some implementations a venting path may be provided from the pre-filled launch tube 116 around the baffles 206 as the projectile 118 approaches. As discussed above, the area change of the baffle 206 compared to the launch tube 116 assists in expansion and lowering of pressure ahead of the projectile 118 compared to a full caliber launch tube 116.

A "T" ("tee") of ram gases and inert gases may be injected at an angle to the ram acceleration system 124 section, allowing continuous back-filling of ram acceleration system 124 gases 128 while those gases 128 push towards the low pressure section (launch tube 116) and evacuated ram acceleration system 124 sections. As a result of the angle, the projectile 118 is allowed to transit past the injection tube. The gases 128 may be sequenced to prevent any undesirable combustion or detonation during projectile 118 transit. This "parallel" gas source acts like a shock tube source keeping the ram acceleration system 124 section filled to the right pressure and velocity of the gases 128.

Features such as rail 222 to inner-tube diameter spacing, diameter, or in case of baffle tube section 202 ram acceleration system 124, baffle 206 angles and spacing and geometry can be optimized to match the desired gas velocity, and relative velocity gas pressure required to optimize the flow field is matched to best ram acceleration system 124 performance for ram acceleration system 124 masses and geometries (nose angles, length, center of gravity (CG)), shock induction features (protuberances), and on-board propellants (solid fuels or oxidizers on the board as function of radius and length, etc.)

In some implementations, the notches of the rail 222 and the baffle 206 may be arranged opposite one another, allowing the rail 222 to be inserted from the inner diameter. Loading supports may be inverted where structural pinned supports of the baffle 206 form the rail 222 from the notch directly and the pins, bolts, or wedges are inserted at the interior location. This allows adjustment of the rail 222 concentricity and gap, by using a long calibrated oversized projectile 118 cylinder to set the alignment of the rails 222 during assembly and attachment. This approach allows for smooth rail 222, continuous between rail 222, likely offering lower intermittent drag and scalloping between rail 222 sections, as well as providing direct reaction of the larger span simple load supports interacting between baffle 206 and rail 222. For example, the larger the span, the higher the load. Likewise, the shorter the inner span, the lower the load on the pins, if used. In some implementations a pin may be avoided all together by using a joint at the bottom (smaller diameter area of the notch) and using a tack weld at the outer perimeter to support the baffle 206 with the rail 222.

As shown in the figures, the inner rail 222 may be relatively smooth. The rails 222 keep the projectile 118 from canting, while the gap between the inner rail 222 and the inner diameter of the baffle 206 allows the shockwave effects desired for ram acceleration combustion.

In some implementations, the gap between the pressure tube 160 and the baffle 206 and/or rail 222 may be filled with a solder/weld alloy, or temperature or pressure activated adhesive. This allows for simple assembly of the rail 222 and pressurize contact assembly and welding and fusing of the rail 222 and or baffle 206 section to the inner wall of the pressure tube 160. The temperature or pressure change of a long over-caliber projectile 118 as an alignment tool can swell at a higher rate than the steel tube and rail 222 for example, or rails 222 and or baffle 206 could have different coefficients of thermal expansion (CTE) forcing the high-pressure contact and better bonding for metal or composite adhesion of the rail 222 and baffle 206 to the tube walls. This allows for long sections of baffle 206 to be manufactured quickly and cheaply. In some situations, manufacture may occur in-situ.

The baffles 206 or rails 222 themselves may be fiber or steel (rebar) reinforced and then cast by section to final form to create the baffle 206 and rail 222 section with the metal, composite, and so forth. The portions comprising a rail 222 and/or baffle 206 may involve critical geometry as they come into contact or are near the projectile 118 during transit. In comparison other elements are less critical during manufacture, such as the inner diameter of the pressure tube 160.

The pressure tube 160 may comprise fiber reinforced material.

The valves described herein may comprise re-usable valves that are operable to transition between a closed and an open state. In some implementations the valves may include a flapper, ball, gate, dual clam shell, and other valve types. In other implementations the valve may comprise a diaphragm or single-use device. Valves may be mechanically, pneumatically, electrically, magnetically, chemically, or pyrotechnically operated.

In some implementations the valves may provide a variable cross-sectional area over time, to provide for controlled mass flow per unit time.

In some implementations, passages, pipes, or other features may be included in one or more of the pressure tube 160, the baffles 206, or other structures to allow for transport of gases 128 to their respective sections.

Discussion of Dynamic RAM Acceleration System

In some implementations, the following components of the ram acceleration system 124 may be present. In some implementations, one or more of these components may be omitted, or other components used to provide the same or similar functionality.

A breech which provides gas chemical energy for movement of a projectile 118 may start motion. Motion may result from pressure of a cold gas or combustion of a gas that is initiated via spark, heat, compression, and so forth. Other systems may be used.

A breech throat is the interface between the breech and launch tube 116. The breech throat holds an obturator 120 and a projectile 118 prior to a start gun launch event. In some implementations, plastic separators or cups may be used. The interface may be bolted or bolted-thread-compressed mylar thin diaphragms.

A launch tube 116 may be evacuated between the breech and a first ram section.

An obturator 120 may be connected to the base of the projectile 118. Transmitting the breech pressure load to push the projectile 118 up to ram speeds. The obturator 120 also provides a gas dynamic start function at point of contact with the ram gases 128. The obturator 120 may include a sealing mechanism.

A projectile 118 may be either a finned projectile 118, for instance, with a shoulder diameter sub-caliber to the launch tube 116 diameter with fin spacing allowing for ram gas passage and compression around the ram projectile 118 body or an axisymmetric projectile 118 flying through the baffle tube section 202 or spacers with no fin allowing for ram gas passage and compression around the ram projectile 118 body through the baffles 206.

An entrance diaphragm or cap preventing gases to enter launch tube 116 via pressure retaining may burst at impact or upstream timing. This may be omitted in one or more of the implementations described herein.

Initial stages or sections 1, 2, . . . , N of the ram acceleration system 124 may use gases 128, such as a mixture of one or more of fuel, oxidizer, or diluent premixed at pressure to affect ram acceleration.

Stage separators prevent stage gases 128 from mixing during fill. The stage separators may comprise ball valves, plastic separators, or cups. The stage separators may be bolted or thread-compressed mylar thin diaphragms. These may comprise a permanent valve that is actuated or replaceable diaphragms that are burst actively with, for example a pyro initiation, gas initiated, or simply a passive piercing impact.

An exit diaphragm or end cap may prevent ram acceleration system 124 gases at pressure from exiting, prevent outside atmosphere from entering, and allow projectile 118 passage. For example, plastic separators or caps may be used. The diaphragms may be bolted or thread-compressed mylar thin diaphragms.

The ram start velocity relative velocity (initial velocity) between the projectile 118 and the ram acceleration system 124 gas may be 1100 m/s for Nitrogen (diluent) based fuel/oxidizer, or may be lower, such as 550 m/s for baffle tube section 202 ram acceleration systems 124. The diluent gas (N2, Co2, etc.) is used to manage sound speed and provide a fluid medium for ram jet compression during projectile 118 in ram acceleration system 124 start and operation while the pre-mixed fuel and oxidizer provide the energy source for start and sustained combustion.

For example: a 2.2 Ch4+9.5 Air molar ratio has very predictable start performance at 1100 m/s for small projectiles (100 gram approximate mass). In a research setting, a high performance cold gas gun such as high pressure helium is used to push projectiles to Mach 2.5 (relative to the ram dases downstream of the launch tube 116 barrel.) Due to sound speed of helium at medium to high pressures (6000 psi) in a 38 mm (1.5") tube instance is sufficient to bring this projectile 118 to even higher velocities than 1100 m/s without the need for an intermediate ram acceleration system 124 stage to move from 1100 m/s to 1500 m/s for entry into other ram acceleration system 124 configurations.

Helium gas operations are well known but have serious drawbacks. The cost of helium gas itself is expensive and specialized equipment is required to pump from nominal tank pressures from industrial suppliers (2000 psi) up to 6000 psi are also expensive from a capital standpoint as well as slow from an operational standpoint. The use of hydrogen, also with a favorable sound speed has lower cost operations for the gas itself, but also requires expensive complex pumping systems to similar pressure and due to the ease of flammability of the hydrogen gas, presents difficulty. Additionally the use of other types of specialty gas guns such as two stage gas guns with pre-heating of gases also provides similar if not higher levels of complexity and costs to have sufficient performance to bring various projectiles 118 up to velocity to produce ram acceleration. Some of the beneficial values of light gas guns is that there is no requirement for a combustion mechanism (spark plug, etc.), no heat buildup or combustion products to coat and/or contaminate the launch tube 116 and breech, as well as the low temperature operations of the gas from the breech to the launch tube 116 with low temperature, there is very little potential for erosion of the interface between the breech and the launch tube 116 called the throat, nor erosion of the launch tube 116 itself. However, this simplicity of operation comes with complexity and cost as discussed above in the gas 128 and pressurization operations, but it also comes with complexity of release of the gases to initiate movement of the projectile 118. In some implementations one or more fixed diaphragm stages are manually placed and mechanically sandwiched (both, threaded, etc.) where the breech is filled to full pressure and the diaphragm(s) are broken in sequence to allow the rush of high pressure gas 128 to provide a high force and thus high acceleration to activate movement behind the ram acceleration system 124 projectile 118 (and obturator 120). This sequence may be started by a mechanical release of breaking mechanism on the diaphragms, or the pressure exceeding the strength of the diaphragms is enough to break the diaphragm and begin projectile 118 acceleration. Placement and replacement of this method may be expensive and time consuming. Automating the process with diaphragm caps or plugs replacing the sandwiched diaphragms that mechanically repetitively seats, seals, and releases reliably at high pressures (6000 psi) is possible, but due to the high pressure requirements this process requires significant design strength and high tolerances to work repetitively.

Other methods of start guns such as combustion gas guns (CGG) or combustion light gas guns (CLGG) operate to create mass driver motion with combustion of some or all of the gas 128 in the tube behind the projectile 118. The heat and pressure created from the combustion (such as stoichiometric methane+pure oxygen or stoich methane-air) are ignited and then move the projectile 118 (and the gas 128) down the tube providing velocity for ram acceleration. The value of combustion gas guns as the ram acceleration system 124 start gun as the sole means of creation of start velocity for ram acceleration system 124 projectiles 118 is at first glance a simpler and more elegant method for a start gun. The combustion gas gun allows for low fill pressure of the propellant gases 128 (fuel, oxidizer, and diluent or inert) while there is substantially less gas mass required and fill pressure approximately an order of magnitude compared with cold gas and light gas start guns. There are problems associated with combustion guns as start guns such as the rapid temperature and pressure increases of the gases 128 at ignition create high pressure and temperature loading on the breech, launch tube 116, and filling equipment (lines, valves, etc.), as well as high pressure and temperature spikes on the ram acceleration system 124 projectile 118 and the obturator 120. A 20-50× pressure spike multiple over fill pressure may be experienced on the upstream end of the breech and on the base of the obturator 120 attached to the projectile 118. For example, a 500 psi fill of Oxygen+methane in stoichiometric conditions may have pressure spikes up to 70,000 psi. The pressure spike against the areas that obturate the projectile 118 to get up to speed for light mass projectiles (100 grams and 38 mm diameter) may produce extreme forces and thus accelerations on the structure. The projectile 118 and obturator 120 may experience 10,000's to 100,000's of "G's" multiples of earth gravity of 9.81 m/s^2, thus large destructive loads are pressing on the projectile 118 and any payload encapsulated (electronics, satellite, passengers, etc.) This then requires significant structural capability in the breech as well as heavier and more structurally capable obturators 120 and projectiles 118. The heavier structures in turn require more mass and thus more start gun propellant and pressure to get up to ramming velocities of 850 m/s to 1100 m/s. One additional issue that also affects the reliability, repeatability, cost, and timing of operations is the throat erosion (breech to launch tube 116) and launch tube 116 erosion due to high temperature gases 128 created in the combustion event.

Rather than using solid gas generator materials such as black powder, gun powder, ANFO, etc., in one implementation, to use low cost gaseous combustion propellants such as methane, hydrogen, oxygen, air (21% ox, 78% nitrogen etc.) for ease of handling, safety, and ease of evacuation and cycle time of propellants. Also, it is preferable, but not required for the combustion gun system to consume all of the propellants leaving no additional fuel or oxidizer after combustion, thus the goal is stoichiometric mixtures that leave nothing but $CO_2$, $H_2O$, and trace amounts of CO, etc., and any inert gases (such as nitrogen, etc.).

A key differentiator between operability of guns and the ram acceleration system 124 is that in guns, a significant portion of the hot combustion propellants reach the speed of the projectile 118. With the above specified gaseous propellants comes higher temperatures than typical powder guns. A powder gun may have a gas temperature of 1600 degrees Kelvin compared to 3000 degrees Kelvin or higher for Stoich Methane-Pure Oxygen for instance for a combustion gun. With that gas mass, gas temperature, and the gases moving at high velocities (1000 m/s or more) it creates a potentially high erosive flow causing wear and change of diameter of the breech, launch tube 116 (barrel), and the throat. In some cases the throat joining the breech and the launch tube 116 is a neck down where there is significant chamberage between the breech diameter (larger) and the launch tube 116 diameter and the throat converges the flow from a large diameter to the projectile 118 diameter. This change in area also influences significant further temperature and pressure loading on the throat. Additionally, the throat is where the projectile 118 and obturator 120 sit statically prior to combustion and in the case of a gas-filled breech, the obturator 120-projectile 118 unit may provide the sealing mechanism during the breech filling process. This has been done with bridgeman seals, o-rings, and a variety of other mechanisms such as shear and locking mechanisms. The throat may see a high pressure differential and temperature differential between breech and launch tube 116. The highest heat flux and any changes in geometry, joints, etc. under supersonic or hypersonic flow may also set up shock waves and other combustion related interaction where those protuberances are exposed to the hot, high speed erosive gases of combustion and get extremely hot to the point of melting, diameter widening, pitting, or other damage to the throat.

The throat is the preferred location to have at least minor geometry changes to afford automation interfaces for obturator 120-projectile 118 placement, and sealing and release mechanisms. For instance, a minor throat neck down (17-15 degree throat contraction) to a slightly smaller diameter than the breech (say a 45 mm breech to a 38 mm launch tube 116), offer an excellent location to lock in a projectile 118 with an o-ring and a shearing mechanism to hold and seal the obturator 120-projectile 118 while the breech is filled with propellant that will then be ignited after filling, and the projectile 118 shear lock is broken or released allowing movement of the projectile 118 in a repetitive fill and fire mechanism of the gun.

In order to afford low-cost, highly reliable components in the operations of the ram acceleration system 124 this start gun system should likely be more reliable by operating in conditions that are similar to those experienced in powder guns, meaning lower pressures and temperatures. Powder guns may be operated through many cycles without significant degradation of performance of the breech, throat, and barrel. Most guns have a brass shell that does absorb some of the heat of breech combustion and the interfaces from breech to barrel (launch tube 116) are minimal, nearly mono-bore. The obvious drawback of powder guns is having the adverse safety issue of pre-mixed oxidizer and fuel and extra mass for brass casing. Lower velocity performance is one of the key drawbacks to operating with either powder guns or low performance combustion gas guns. The sound speed is typically lower (Air/Methane, etc.) and pressures are lower, thus the loads on the obturator 120-projectile 118 are also lower, but ultimately the final velocity at exit is also lower than may be theoretically gained with such guns as helium or hydrogen light gas guns or stoichiometric combustion gas guns. This means that in order to achieve start velocities consistent with ram acceleration system 124 operations additional efforts may be used on the ram acceleration system 124 to initiate start at lower velocity. Such efforts may include mechanisms such as on-board ignitors between the obturator 120 and the projectile 118, or use of s baffle tube section 202 ram acceleration system 124 allowing for higher energy propellants to start at lower entrance velocities, and so forth. The simplicity of a spark ignition and simple low cost propellants for a start gun are very appealing for ram acceleration system 124 operations.

In one implementation a start gun for a ram acceleration system 124 is a low-cost air or nitrogen cold gas gun or a low temperature combustion gas gun with powder-gun reliability (defined by gas temp and velocity), with relative velocity of the projectile 118 with the gases 128 approaching 550-1100 m/s for ram acceleration system 124 start.

The cold gas gun start gun (nitrogen gun, or air gun) mechanism is extremely low cost with today's air compressor technology in capital cost and operations, but is fundamentally limited by sound speed of the gas. In practice, operating a gun at 2-2.5× the gas speed of sound expanding the gas to move the projectile 118 is about the maximum reasonably attainable. A speed of 1-1.2× speed of sound is very low cost and easy to achieve.

Cold heavy gas guns, similar to their hydrogen/helium gas gun counterparts offer very simple, predictable gas handling and modes shock pressure loading on the breech as well as the obturator 120-projectile 118 system. Air or nitrogen based systems are relatively simple, low cost and may provide low shock loading on the obturator 120-projectile 118 system, allowing for low-cost operations for shock intolerant payloads such as satellites and human space capsules.

Hot steam catapults and other mechanisms with high sound speed and low-cost operations such as aircraft carries are also options with added complexity over simple gas guns and combustion guns. Other methods may be used to improve the launch capability of the system including a sabot that provides as larger area through a larger diameter and then release of the sabot is accomplished at the end of the launch tube 116.

The ram acceleration system 124 is also sound speed dependent. A nitrogen diluent mixture may be used to modify sound speed resulting in start velocities of approximately 1100 m/s. Using CO2– based diluent mixtures having CO2+methane+oxygen with a lower sound speed have allowed reliable ram acceleration system 124 start operations at 820-850 m/s. For ram acceleration system 124 start it is critical to have the relative velocity of the projectile 118 moving from the launch tube 116 into the pre-mixed ram acceleration system 124 gases 128 to be of sufficient velocity to create the compression needed for autoignition of the fuel-oxidizer mixture in the CO2 or nitrogen (diluent) based gas mixture 128 and the setup of thermal choked normal shock operations, allows self-synchronized combustion of the propellants on the base of the projectile 118.

What is presented in this disclosure are systems, techniques, and methods of relative velocity of the obturator 120-projectile 118 to the oncoming ram acceleration system 124 gases 128. A timed release of projectile 118 motion and a cap/valve is presented to lower required start gun performance among other advantages in cost, cycle time, and ram acceleration system 124 operations.

What is presented in this disclosure is a method for managing the relative motion between the projectile 118 and the ram acceleration system 124 (smooth bore, rail 222*ed*, baffle tube 202, spacer, and so forth) gas 128, and the movement, timing, and speed of the ram acceleration system 124 gas 128 towards the projectile 118 while the projectile 118 is accelerating towards the flowing gases 128. The mechanism used may include hinged valves, gate valves, ball valves, etc. The gases 128 and the flow pattern (velocity and pressure) of the gases 128 that move in the ram acceleration system 124, especially gases 128 in the baffle tube section 202 ram acceleration system 124 may move and velocities (and pressure) of the gases 128 may be modified (faster, slower) towards the projectile 118, based on the gas constituents, initial pressures, temperatures, and internal flow path and interaction with the open systems (valves, etc.).

For the example shown, there is a section of the ram acceleration system 124 tube (baffle tube section 202 in this case), that has one or more sections filled at a pressure with ram acceleration system 124 gases 128 that are higher than the desired ram acceleration system 124 operation pressure intended for the projectile 118 passage. A projectile 118 is positioned upstream of a ram acceleration system 124 tube, start gun gases 128 (cold gas or hot or combustible gases) are held behind the projectile 118 ready to push the projectile 118 down stream. The launch tube 116 and unfilled ram acceleration system 124 section upstream of the hinged flapper valve separating the filled ram section are at a low pressure (vacuum, etc.) to provide low gas-aerodynamic resistance to the flight so the projectile 118 moves towards the expected oncoming gases 128. The first stage through n ram inner stages may be filled with gases 128 such as combustible oxidizer and fuel mixtures for the ram acceleration system 124 and a different level of diluent (N2, Co2, etc.) to tailor the sound speed expected by the passage of the projectile 118 to keep it in optimal range for the ram acceleration system 124 (Mach 2-Mach 5) within the gas 128. One or more ball valves may be used to fill different stages and opened (slowly or high speed) to allow passage of the projectile 118. Prior to ram acceleration, these prefilled stages are essentially a staged gas-spring ready to expand out of this central section to fill the evacuated or low pressure unfilled ram sections.

Before initiation of movement of the projectile 118 towards the ram acceleration system 124 stage, the upstream hinged flapper valve is opened and the "gas spring" begins its release to fill the upstream section of the ram acceleration system 124 where the higher pressure gases 128 from the filled section begin to expand towards the lower pressure ram section and towards the launch tube 116 upstream. In a smooth bore ram acceleration system 124 this expansion would look like a shock tube expansion with gases 128 moving quickly upstream towards the projectile 118 and may move at speeds up to 2-3× the speed of sound with no significant mass to push, however with valve actuation, mass, and inertia of the hinged flapper valve, and spacer or baffles 206 (with intention of gas routing features like a silencer) the gases 128 may take a more tortuous internal flow path slowing the average gas speed (and core gas in baffle tube section 202 central zone) towards the projectile 118. This provides tailoring of the velocity of the gases 128. The multi-part gas (N2, O2, methane, etc.) could have mixing promoted due to flow of the gas 128 through the tortuous geometry of the baffle tube section 202 ram acceleration system 124 or rail 222 tube for example. Passages in the baffles 206 may be designed to allow gas reverse flow during the expansion before combustion as well as combustion wave propagation etc.

At a specific time the projectile 118 begins its acceleration down the (evacuated) launch tube 116 and towards the ram acceleration system 124 section with an increasing velocity Vp. The gases 128 in the ram acceleration system 124 section meet the projectile 118 at a location defined by gas Velocity (Vg2) at a pressure defined by expansion of the gas 128 (ideal gas for example: P1V1=P2V2) defined by the volume the gas 128 has expanded into. The relative velocity vector (Vp−Vg2) provides the required velocity to initiate a shock wave compression in the correct geometry configuration (baffle tube section 202 area ratio is larger for lower speed start, for example) for the pressure and chemistry required for ram acceleration system 124 start and sustained combustion. The baffles 206 and timing may provide for the initial entrance velocity of the projectile 118 into a partially evacuated section and the gas 128 behind the projectile 118 (and obturator 120 if necessary) allowing the start-gun gases 128 to expand (and slow down) lessening the inert gas pressure effect on the ram acceleration system 124 start process. In some implementations the ram acceleration system 124 may operate in a ventless mode.

The projectile 118 at the point of contact with the oncoming gases 128 from the valve may have an on-board pyrotechnic that has been initiated, is initiated upon acceleration (at start or slow down of the oncoming gases 128), or externally triggered. Something similar to a continuous flare, an explosive or a spark, may be used for its heat and chemistry or catalytic effect to further make the activation energy lower for ease of combustion and further lower the required relative velocity of the projectile 118 and ram acceleration system 124 gases 128.

As the projectile 118 accelerates in the ram acceleration system 124, it passes by the valve that allows for full passage of the projectile 118 and continued operation in the expanding gas field in the ram acceleration system 124. The projectile 118 passes the separator ball valve which allows repetitive multi-stage fill operation, separating between ram fill 1 and 2 and n stages that use sound speed modification with diluents as described above. The downstream valve may be timed and actively controlled (or may simply be diaphragm-active or passive) that the ram projectile 118 passes through while it continues to accelerate.

The system geometry (total ram length, baffle 206 angles, shapes, fluid connection between rails 222, baffles 206, spacers, etc.) presented defines the required fill pressures of the middle section of the ram acceleration system 124 that provides the source gas 128 for the ram acceleration event. The projectile 118 will fly into a moving gas field and will accelerate and continue to fly at a changing relative velocity due to its own acceleration based on ram combustion as well as flying into an expanding and then possibly retreating gas field.

The retreating gas field may be timed in such a way with the down stream valve(s) actuate to provide a similar function of sound speed modification that the diluent provides, keeping the relative velocity in the optimum mach number range for efficient operations without having to modify the diluent for sound speed purposes only.

Additionally, the gases 128 downstream of the downstream valve or upstream of the upstream valve may be a low pressure evacuated region or a tailored gas mixture and pressure that provides an inertia of gas that is to be moved so it properly damps the speed of the expanding gas 128 within the filled inner section of the tube.

For short-length, high acceleration ram acceleration systems 124, the timing of the valves and associated movement of the gases 128 in the ram acceleration system 124 and movement of the projectile 118 is controlled. In one implementation, the system 100 may have the upstream valve open or nearly open to guarantee free passage of the projectile 118 before the projectile 118 is released.

Those having ordinary skill in the art will readily recognize that certain steps or operations illustrated in the figures above can be eliminated, combined, subdivided, executed in parallel, or taken in an alternate order. Moreover, the methods described above may be implemented as one or more software programs for a computer system and are encoded in a computer-readable storage medium as instructions executable on one or more processors. Separate instances of these programs can be executed on or distributed across separate computer systems.

Although certain steps have been described as being performed by certain devices, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific implementations, various changes and modifications may be suggested to one skilled in the art and it is intended that the present disclosure encompass such changes and modifications that fall within the scope of the appended claims.

Illustrative Advantages

The systems and techniques described herein provide a variety of possible advantages. These include, but are not limited to the following:

Lower velocity requirements for the pre-launch system 110, such as the start gun. This allows simple air gas guns and also provides for low acceleration operations suitable for sensitive payloads.

Reduction or removal of one or more frangible diaphragms, reducing cost to re-cycle, speeding up cycle time, and avoiding frangible materials contaminating the ram acceleration system 124.

Reduction or removal of ram accelerator fuel on-board the projectile 118, improving the safety characteristics.

Avoiding the complications and safety issues with detonation of pre-mixed fuel and oxidizer in the tube. Use of the techniques described herein lowers structural requirements on the baffle tube section 202 that would take an unstart pressure 10-50× the fill pressure (making the tube expensive and thick) with a runway detonation which may occur during operation.

Ability to quench the combustion if we want to stop the acceleration or throttle to tailor the acceleration profile or even capture the projectile 118 in the tube after a certain test section of combustion.

Compatible with use of a solid fuel ram acceleration system 124 or a liquid or gaseous fluid injection from the nose or sidewalls to assist with structural skin cooling as well.

Some implementations allow omission of an ignitor on the obturator 120 or projectile 118.

Allows use of a near constant acceleration pre-launch system 110, such as a start gun. Allows use of a variable area cold gas gun or multi-orifice gas gun which allows for a tailored acceleration profile for sensitive payloads to start velocity. With lower velocity requirements on the projectile 118, this simplifies the system from a cost and injection complexity perspective, decreasing cycle time between launches and making the system safer for occupants and payloads.

The National Aeronautics and Space Administration (NASA) and other agencies specify human-rated systems to have an acceleration that is less than approximately 20 G. By using the techniques described herein, accelerations of less than 20 G may be maintained while providing the projectile 118 with exit velocities of 1750 m/s. Depending on implementation, the launch tube 116 may have a length of 1 km and the ram acceleration system 124 may have a length of 8 km. An example of a typical ram acceleration system 124 N2 diluent based propellant (air-methane) is described below.

Because the physical size (length and overall volume) of the system that is suitable for sensitive payloads, timing is on the order of many seconds for the propagation of the gas wave from the ram fill section expanding towards the projectile 118. As a result, it is possible to ensure all valves are open before initiating movement of the projectile 118, improving safety to the payload.

The propagation speed of the gas 128 may also be controlled by maintaining a specified temperature of one or more sections of the launch tube 116, ram acceleration system 124, or the gas 128 therein. For example, one or more of the first section or the second section of the ram acceleration system 124 may be heated or cooled to a specified temperature before initiation of the pre-launch system 110. Continuing the example, one or more of the baffles 206, pressure tube 160, rails 222, and so forth may include thermal transfer devices. In another example, the first fill gas 128 may be heated or cooled to a specified temperature before initiation of the pre-launch system 110.

In another implementation the spacing between baffles 206 may be varied to provide relatively large increases in volume, producing a temperature drop upon a gas 128 entering that volume.

The system 100 may maintain conditions that are ready for flight "takeoff" with gas expansion and even provided large valves or diversion channelsjust after the projectile 118 that are open or released after all safety conditions are met for movement of the projectile 118. The shorter high G-load systems for industrial uses may use pyro-initiated events or CLGG (combustion light gas guns) to trigger the movement of the projectile 118 and perform synchronized timing of the projectile 118 movement with the upstream and (optional downstream) ram acceleration system 124 valves. In one implementation, it is possible for high speed valves to release a thin moveable diaphragm 640 of some mass to retain the gas shock train instead of it being an open wave.

Applications

Further applications of the systems and techniques described herein may be used to move projectiles for other use cases. This may include using projectiles for geotechnical drilling, mining, and so forth. For example, a projectile 118 may be launched towards a material to interact with the material. In one implementation, during construction, completed portions of the ram acceleration system 124 may be used to launch projectiles against a working face to aid in the excavation of a tunnel within which to continue constructions of the ram acceleration system 124.

In some implementations, the system may be used to launch projectiles to provide transport of materials within those projectiles, such as for terrestrial transport of materials, for launching materials into orbital or suborbital trajectories, conveying passengers, and so forth. In other implementations, the system may be used to direct projectiles at high velocity to impact on a working face, such as for drilling, tunnel boring, excavation, material fracturing, and so forth.

What is claimed is:

1. A system comprising:
- a pre-launch system comprising;
  - a launch tube having a launch tube entry and a launch tube exit;
- a ram accelerator system comprising:
  - a first section having a first end and a second end, wherein the first end is proximate to the launch tube exit;
  - a second section having a third end and a fourth end, wherein the third end is proximate to the second end;
  - a first fill stage having a fifth end and a sixth end, wherein the fifth end is proximate to the second end and the sixth end is proximate to the third end;
  - a first valve between the fifth end and the second end; and
  - a second valve between the sixth end and the third end;
- a gas control system; and
- a control system in communication with the pre-launch system and the ram accelerator system, the control system to:
  - operate the first valve and the second valve to close at a first time;
  - operate the gas control system to fill the first fill stage with a first gas at a second time, wherein the second time is after the first time;
  - operate the first valve to open after the second time;
  - operate the second valve to open after the second time; and
  - after opening the first valve and the second valve, initiate operation of the pre-launch system to launch a projectile, wherein:
    - the projectile is launched such that as the projectile enters the first section, the first gas moves in a direction that is opposite to the projectile and past the projectile, resulting in a first relative velocity of the first gas with respect to the projectile that is a sum of a velocity of the first gas and a velocity of the projectile, and
    - the projectile is launched such that as the projectile enters the second section, the first gas moves in a same direction as the projectile, resulting in a second relative velocity of the first gas with respect to the projectile that is a difference between the velocity of the first gas and the velocity of the projectile.

2. The system of claim 1, further comprising an exit diaphragm proximate to an exit of a section of the ram accelerator system to a surrounding environment, wherein the exit diaphragm is penetrated by the projectile.

3. The system of claim 1, wherein the first section is evacuated before initiation of the pre-launch system to launch the projectile.

4. The system of claim 1, wherein the first section contains the first gas before initiation of the pre-launch system to launch the projectile.

5. The system of claim 1, wherein one or more of the first section or the second section are at a specified temperature before initiation of the pre-launch system.

6. The system of claim 1, wherein the first gas is at a specified temperature before initiation of the pre-launch system.

7. The system of claim 1, the ram accelerator system comprising at least one baffle tube section comprising a plurality of baffles.

8. The system of claim 1, the ram accelerator system comprising a plurality of baffles and a plurality of rails, wherein the plurality of rails are mechanically engaged to the plurality of baffles and the rails constrain movement of the projectile within the ram accelerator system.

9. The system of claim 1, the pre-launch system further comprising:

the gas control system to provide pressurized gas to the launch tube;

a third valve proximate to the launch tube entry, wherein the third valve is operable to provide an opening with a time-variable cross-sectional area between the gas control system and the launch tube; and the control system to:

operate the third valve to provide:

a first specified mass flow of launch gas through the third valve and into the launch tube at a third time, and a second specified mass flow of launch gas through the third valve and into the launch tube at a fourth time.

10. The system of claim 1, the projectile comprising a space vehicle.

11. The system of claim 1, wherein the projectile is stationary prior to the projectile being launched.

12. A system comprising:

a pre-launch system comprising;

a launch tube having a launch tube entry and a launch tube exit;

a ram accelerator system comprising:

a first section having a first end and a second end, wherein the first end is proximate to the launch tube exit;

a second section having a third end and a fourth end, wherein the third end is proximate to the second end;

a first fill stage having a fifth end and a sixth end, wherein the fifth end is proximate to the second end and the sixth end is proximate to the third end;

a first valve between the fifth end and the second end;

a second valve between the sixth end and the third end; and a plurality of baffles within one or more of the first section, the second section, or the first fill stage;

a gas control system; and a control system in communication with the pre-launch system and the ram accelerator system, the control system to:

operate the first valve and the second valve to close at a first time;

operate the gas control system to fill the first fill stage with a first gas at a second time, wherein the second time is after the first time;

operate the first valve to open after the second time;

operate the second valve to open after the second time; and operate the pre-launch system to launch a projectile, wherein:

the projectile is launched such that as the projectile enters the first section there is a first relative velocity between the first gas and the projectile, the projectile is launched such that as the projectile enters the second section there is a second relative velocity between the first gas and the projectile, and the second relative velocity is less than the first relative velocity.

13. The system of claim 12, wherein as the projectile enters the first section, the first gas moves opposite to and past the projectile, resulting in the first relative velocity between the first gas and the projectile that is a sum of a projectile velocity and a gas velocity.

14. The system of claim 12, wherein as the projectile enters the second section, the first gas moves in a same direction as the projectile, resulting in the second relative velocity between the first gas and the projectile that is a difference between a projectile velocity and a gas velocity.

15. The system of claim 12, further comprising an exit diaphragm proximate to an exit of a section of the ram accelerator system to a surrounding environment, wherein the exit diaphragm is penetrated by the projectile.

16. The system of claim 12, wherein the first section is evacuated before initiation of the pre-launch system to launch the projectile.

17. The system of claim 12, wherein the first section contains the first gas before initiation of the pre-launch system to launch the projectile.

18. The system of claim 12, wherein one or more of the first section or the second section are at a specified temperature before initiation of the pre-launch system.

19. The system of claim 12, wherein the first gas is at a specified temperature before initiation of the pre-launch system.

20. The system of claim 12, the ram accelerator system comprising a plurality of rails, wherein the plurality of rails are mechanically engaged to the plurality of baffles and the rails constrain movement of the projectile within the ram accelerator system.

21. The system of claim 12, the pre-launch system further comprising:

the gas control system to provide pressurized gas to the launch tube;

a third valve proximate to the launch tube entry, wherein the third valve is operable to provide an opening with a time-variable cross-sectional area between the gas control system and the launch tube; and the control system to:

operate the third valve to provide:

a first specified mass flow of launch gas through the third valve and into the launch tube at a third time, and a second specified mass flow of launch gas through the third valve and into the launch tube at a fourth time.

22. A system comprising:

a pre-launch system comprising;

a launch tube having a launch tube entry and a launch tube exit;

a ram accelerator system comprising:

a first section having a first end and a second end, wherein the first end is proximate to the launch tube exit;

a second section having a third end and a fourth end, wherein the third end is proximate to the second end;

a first fill stage having a fifth end and a sixth end, wherein the fifth end is proximate to the second end and the sixth end is proximate to the third end;

a first valve between the fifth end and the second end;

a second valve between the sixth end and the third end; and a plurality of baffles within one or more of the first section, the second section, or the first fill stage;

a gas control system; and a control system in communication with the pre-launch system and the ram accelerator system, the control system to:

operate the first valve and the second valve to close;

operate the first section to evacuate;

operate the gas control system to fill the first fill stage with a first gas after the first and second valves are closed;

operate the first valve to open after the first fill stage has been filled with the first gas;

operate the second valve to open after the first fill stage has been filled with the first gas; and after the first section has been evacuated and the first and second valves have been opened, operate the pre-launch system to launch a projectile, wherein:

the projectile is launched such that as the projectile enters the first section there is a first relative velocity between the first gas and the projectile, the projectile is launched such that as the projectile enters the second section there is a second relative velocity between the first gas and the projectile, and the second relative velocity is less than the first relative velocity.

* * * * *